US005462105A

United States Patent [19]

Supernak

[11] Patent Number: 5,462,105

[45] Date of Patent: Oct. 31, 1995

[54] ADJUSTMENTS FOR WINDOW SHADES

[76] Inventor: Janusz Supernak, 4905 Caminito Exquisito, San Diego, Calif. 92130

[21] Appl. No.: 925,871

[22] Filed: Aug. 7, 1992

[51] Int. Cl.[6] ..... E06B 9/08

[52] U.S. Cl. ..... 160/323.1; 160/238; 248/266

[58] Field of Search ..... 160/323.1, 903, 160/263, 262; 248/266, 267, 268, 269, 272

[56] References Cited

U.S. PATENT DOCUMENTS

| | | | |
|---|---|---|---|
| 971,414 | 9/1910 | Smith . | |
| 1,113,181 | 10/1914 | Ardito . | |
| 1,870,730 | 8/1932 | Hyland . | |
| 1,901,674 | 3/1933 | Slobotkin . | |
| 2,013,500 | 9/1935 | O'Conner | 248/269 |
| 4,006,770 | 2/1977 | Ferguson | 160/263 |
| 4,372,432 | 2/1983 | Waine et al. | 192/8 C |
| 4,433,765 | 2/1984 | Rude et al. | 192/41 S |
| 4,979,775 | 12/1990 | Klose | 296/97.1 |
| 5,092,389 | 3/1992 | Tedeschi | 160/323.1 X |
| 5,135,279 | 8/1992 | Beatty | 160/570.2 A |

FOREIGN PATENT DOCUMENTS

| | | | |
|---|---|---|---|
| 3244880 | 6/1984 | Germany | 160/263 |

*Primary Examiner*—Blair M. Johnson
*Attorney, Agent, or Firm*—Ralph S. Branscomb

[57] ABSTRACT

A variety of methods and devices providing for the angular and lateral adjustment of some types window shades is disclosed. As window openings often reveal a variety of geometric irregularities, several window covering systems, particularly roller type window shades, exhibit poor geometric fit within window openings. The present invention provides for variety of angular and lateral adjustments of shades in order to correct various defects of fit of those shades within window openings by controlling external and internal gaps relevant to the rolling process of the shade.

One method disclosed, referred to as Procedure A, involves the reversal of the roller actuating mechanism from one side of the roller to the opposite end in a Hunter Douglas Silhouette shade. This reversal alters system of forces and moments acting on the shade assembly and brings desirable modifications in both lateral and angular position of the shade.

Another method disclosed, referred to as Procedure B, deals with adjusting the effective diameter of one end or the other of a shade roller. This method allows to effectively control the magnitude of the internal gaps relevant to the rolling process. If it is applicable to various types of roller shades. Several different mechanisms and/or devices allowing to control internal gaps through adjustment of the effective diameters of roller ends, are disclosed.

A third method, referred to as Procedure C, discloses various devices able to torsionally adjust main housing of the shade in order to control the magnitude of the external gaps relevant to the rolling process. This procedure can be performed by either altering position of relevant end plates or relevant mounting brackets, in their relation to the window lintel. Any of the methods or mechanisms disclosed may be combined in many ways as needed or desired for optimum effect.

37 Claims, 23 Drawing Sheets

PROCEDURE A

PROCEDURE B

PROCEDURE C

ADJUSTMENTS FOR WINDOW SHADES

FIELD OF THE INVENTION

This invention relates generally to the alignment of window shades within window casements and, more specifically, to the alignment of the Silhouette shade system developed and marketed by Hunter Douglas Company; the invention is also useful with other types of shades.

BACKGROUND OF THE INVENTION

All window covering systems have to provide a satisfactory and proper geometric fit to the window openings which they cover. While problems associated with an imperfect fit may be less critical for some window covering systems, e.g., draperies, other systems including blinds or shades require rather strict compliance with geometric fit standards. A shade that does not fit properly in its widow opening may be aesthetically deficient and therefore unacceptable. The problem is exacerbated if a poorly fitting shade affects the proper functioning of the shade. For example, a shade may be so skewed within the window opening that one side of the shade may bind against one side of the window opening while the other side of the shade may be separated from the other side of the window opening, leaving a wide, uncovered gap that precludes total privacy. In an extreme case, the shade may be skewed to the extent that it cannot be moved within its window opening without application of excessive force, which may cause damage to the shade or its mechanical components.

Generally speaking, there are three major reasons for an unsatisfactory fit of any window covering system. First, there may be imperfections in the window covering system itself. Second, there may be geometric imperfections in the window opening itself. Third, the shade system may be installed improperly. Since geometric imperfections in the window opening itself are uncontrollable, the need for proper fit adjusting mechanisms or devices and methods becomes imperative. The need is particularly significant in the installation of some modern, highly decorative window covering systems, where improper geometric fit can, in effect, completely ruin the aesthetics of the window covering system.

Roller type window shades are probably most vulnerable to proper geometric fit problems. A major reason is that even the slightest initial imperfection of geometric configuration of the shade within its window opening will be multiplied with every rotation of the shade. Errors in the geometry of the shade system, when added to window geometry imperfections and/or installation errors, result in unsightly shade systems with functioning problems as well. These aesthetic and function problems are quite annoying for the user, particularly if present in some modern, more decorative systems, such as the Silhouette Shading system developed by the Hunter Douglas Company. The Silhouette system offers several desirable features, both functional and decorative that are not found in the conventional, uncomplicated spring wound roller shade, but present difficult geometric fit considerations with extremely close tolerances that must be addressed if a satisfactory installation is to be accomplished.

Some remedies for the problems under discussion are known. For example, uneven, spiral winding of conventional roller type window shades is overcome, more or less, by biasing the downward pull on the bottom of the shade in order to straighten the travel. Similarly, a differential weight bar, used with modern Silhouette shades is intended to rectify some of their geometric fit problems. Such a single solution, however, is often completely inadequate. Its effectiveness is generally poor, as it is able to rectify only one class of its problems and to a limited degree only. What has not been done heretofore is to provide a comprehensive system of procedures and uncomplicated devices that will solve various installation and operation problems which may be encountered either separately or in combination with shade systems. Although the primary focus of the instant invention is to facilitate the installation and operation of the Silhouette shade system manufactured and marketed by the Hunter Douglas Company, several of the recommended procedures and devices herein disclosed and claimed may be used with other shade systems existing or yet to be developed ones.

DESCRIPTION OF THE RELATED ART

U.S. Pat. No. 971,414 issued to M. J. Smith on Sep. 27, 1910 discloses a Swinging Support For Window Shades. The device is an additional bracket to which a standard shade may be affixed, which bracket permits arcuate and linear movement. Conversely, the present invention provides for permanent adjustment of chronic imperfections of fit in permanently installed shades, particularly in shade systems where adjustment tolerances are extremely limited.

U.S. Pat. No. 1,113,181 issued to G. Ardito on Oct. 13, 1914 discloses an Adjustable Shade Support which provides for adjustable arcuate displacement of the shade roller from the window lintel. The device is intended to adjustable displace the shade roller from the top of the window, for ventilation.

U.S. Pat. No. 1,870,730 issued to J. L. Hyland on Aug. 9, 1932 discloses a Shade Hanger And Adjuster which device is intended to perform a function similar to the Ardito device discussed above.

U.S. Pat. No. 1,901,674 issued to N. Slobtkin on Mar. 14, 1933 discloses an Adjustable Mounting For Window Shades. The device provides a similar function to that of the devices of the Ardito and Hyland patents discussed above, but also provides a means of skewing the shade within the window opening. The means, however, are unlike those of the present invention.

U.S. Pat. No. 4,006,770 issued to T. A. Ferguson on Feb. 8, 1977 discloses a Window Shade Assembly which allows the shade to be laterally positioned along the roller. However, this repositioning does not address the problem of lateral alignment of the opposite vertical edges of the shade within the window opening or frame.

U.S. Pat. No. 4,372,432 issued to M. Waine et al. on Feb. 8, 1983 discloses a Bi-Directional Clutch for use with window shade mechanisms. No lateral and/or angular adjustment of the shade is disclosed.

U.S. Pat. No. 4,433,765 issued to E. T. Rude et al. on Feb. 28, 1984 discloses spring clutches adaptable for use with window shades. Again, no lateral and/or angular adjustment means are disclosed.

Finally, U.S. Pat. No. 4,979,775 issued to O. Klose on Dec. 25, 1990 discloses an Axially Displaceable Window Shade for Windshield Or The Like. A stationary threaded shaft is provided about which a shade roller revolves and traverses to provide a constant lateral position of the shade depending upon the amount the shade is drawn. No means for adjusting the lateral travel is disclosed, other than providing different thread pitch.

None of the above noted patents, either single or in combination, are seen to disclose the specific arrangement of concepts disclosed by the present invention.

SUMMARY OF THE INVENTION

By the present invention, improved means for the lateral and/or angular adjustment of window shades is disclosed.

Accordingly, one of the objects of the present invention is to provide an improved means of angular and lateral system adjustment which is directly applicable to the Silhouette shade manufactured by Hunter Douglas Company, but which may also be applicable to other types of shades and shade systems.

Another of the objects of the present invention is to provide an improved means for increasing the starting gap where needed and for the alteration of the magnitude and geometry of the forces and moments acting on the system by transferring the shade actuating mechanism from one end of the shade roller to the opposite end, thus to modify, in a desirable fashion, the lateral and angular position of the shade within the window opening.

Yet another of the objects of the present invention is to control the manner in which the shade is wound upon the shade roller, to minimize spiralling and control the magnitude of internal gaps between the edges of the shade and respective ends of the roller when the shade is rolled up and down.

Still another of the objects of the present invention is to provide a means by which a head rail of a window covering system may be torsionally biased in order to control the magnitude of external gaps between edges of the shade and respective edges of the window opening.

With these and other objects in view, which will more readily appear as the nature of the invention is better understood, the invention consists in the novel combination and arrangement of parts hereinafter more fully described, illustrated and claimed with reference being made to the attached drawing.

BRIEF DESCRIPTION OF THE DRAWINGS

Similar reference characters designate corresponding parts throughout the several figures of the drawings.

DESCRIPTION OF THE PREFERRED EMBODIMENTS

Figure 1:
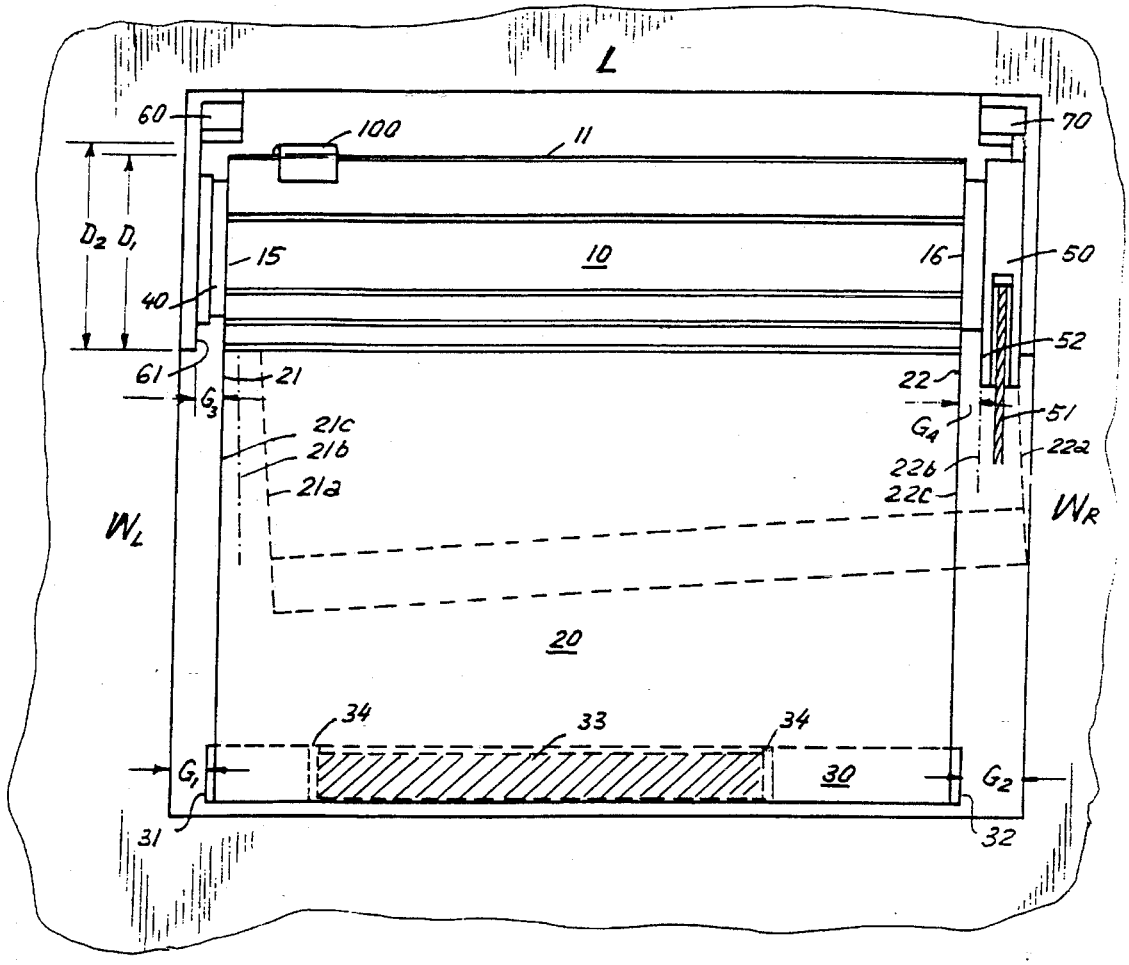
FIG. 1 is a largely diagrammatic front view of a Hunter Douglas Silhouette shade within a window opening showing main components of the shade system as well as the basic geometry of the external and the internal gaps that need to be controlled by use of some modifying devices and procedures, the geometry being shown in exaggerated fashion for clarity of the view.

A. General description of adjustment procedures A, B and C.

Referring now to the drawing, the present invention will be seen to relate to means providing for the angular and lateral adjustment of roller type window shades, particularly the type of shade known as the Hunter Douglas Silhouette but extendible to other shade types, to provide for the various angular and lateral adjustment of roller type window shades within a window frame.

FIG. 1 shows the main components of the Silhouette shade assembly and the fundamental geometry of the external and internal gaps relevant to the shade adjustment procedures and devices. The central roller 10 allows shade 20 to be rolled up or down with a weight of lower bar 30 attached to the bottom of the shade. Through roller end plug 40 and roller and roller actuating mechanism 50, roller 10 is attached to end plates 60 and 70. A single cord 51 of the roller actuating mechanism 50 is used to roll shade 20 up and down. The entire Silhouette assembly is attached to the lintel L by the means of the mounting bracket 80 (not shown in FIG. 1 for clarity) attached to the central housing 90 (again not shown) that connects both end plates 60 and 70 and covers the front of roller 10.

As previously discussed in the Background of the Invention, any roller-based window covering system may experience difficulties with the control of the shade rolling process. Generally, it is expected that the shade should provide even coverage of the window opening.

Often, however, one edge of the shade will be closer to the corresponding window opening that the opposite shade edge, and in fact may even bind or interfere with the side of the window opening. The resulting wrinkles in the generally planar sheet material of the shade are unsightly, and the corresponding gap at the opposite side precludes the privacy which may be desired when the shade is drawn.

The above lack of congruity of the drawn shade with the window opening may be due to a variety of reasons. It is recognized that no window opening is perfectly rectangular or true: there will always be at least a small fraction of an inch of difference between the top and bottom dimensions of the frame, and/or some small degree of error from the desired right angles of the corners. These errors may be cumulative, and in some cases can result in relatively large gaps between the dimensions of the window opening and the shade.

The inventor has found that the above problem is even more apparent in sophisticated shades such as the Hunter Douglas Silhouette shade. FIG. 1 shows in an exaggerated way for clarity, the essence of the adjustment need of the Silhouette shade. The main idea is not to produce a geometrically "perfect" shade but rather to develop such a system of adjustments that can make the shade fit satisfactorily any, even imperfect, window openings.

Generally, the adjustments can be lateral, angular or both. The essence of the problem is to control the magnitude of the external gaps $G_1$, and $G_2$, as well as internal gaps $G_3$ and $G_4$ during the process of rolling shade 20 up or down. Gap $G_1$ is between the left edge 31 of low bar 30 and the edge of the wall $W_L$. Gap $G_2$ is between the right edge 32 of low bar 30 and the opposite edge of the wall $W_R$. Gap $G_3$ is between the internal face 61 of the left end plate and the left edge 21 of shade 20. Gap $G_4$ is between the right edge 22 of shade 20 and the internal face 52 of the roller actuating mechanism 50. Roller end plug 40 is attached to the left end plate 60 whereas the roller actuating mechanism 50 is attached to the right end plate 70.

FIG. 1 demonstrates the result of a two-step adjustment procedure. Due to a combination of factors, the original process of drawing shade 20 down by pulling cord 51 resulted in a skewed rolling of the shade 20 such that it created a large gap $G_1$ between the edge 21*a* and Wall $W_L$, and on the right side, the right edge 32 of the low bar 30 reached wall $W_R$ (gap $G_2$=0). The shade 20 could not be drawn down freely any further. The original position of the shade 20 represented by the broken line positions of the edges 21*a* and 22*a* corresponds to the roller actuating mechanism 50 being on the left side and roller end plug 40 being the right side of the roller 10. Reversal of mechanism 50 from left end 15 of roller 10 to the right end 16 of roller 10 and plug 40 from the right end 16 to left end 15 of roller 10 resulted in the shade position represented by edges 21*b* and 22*b*. This procedure not only increased critical gap $G_2$ but also brought new angular position of edges 21*b* and 22*b*, partially eliminating the highly undesirable skeweness of shade 20.

Figure 3A:
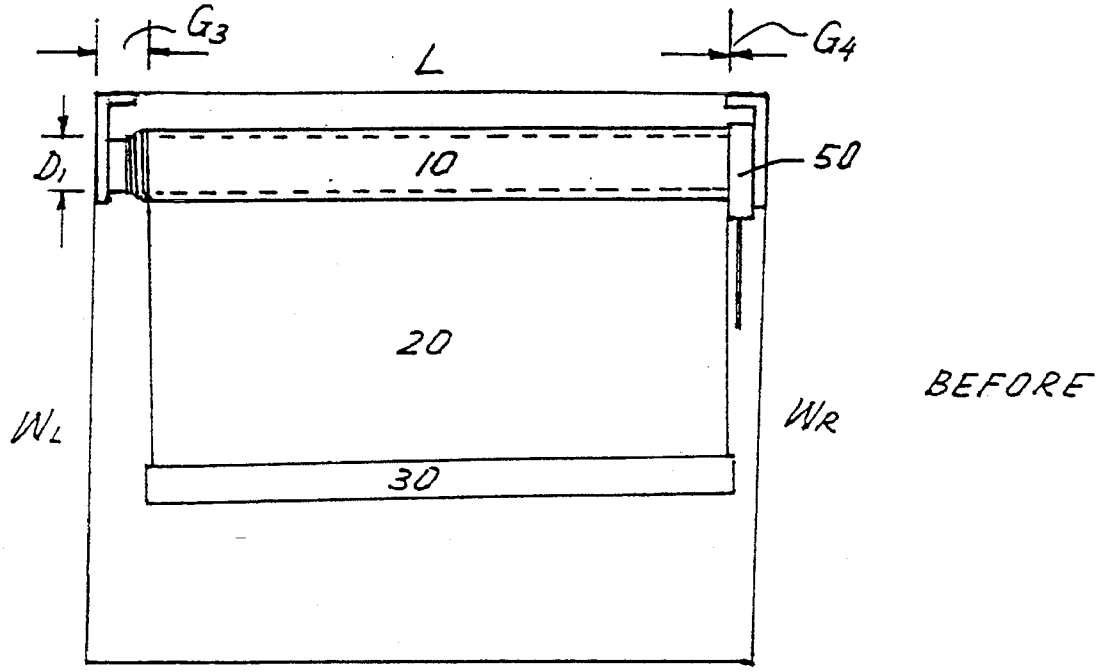
FIGS. 3*a* and *b* are diagrammatic front view of a roller-type shade showing the advantages of the second adjustment procedure namely application of various devices serving to vary the effective diameter of the roller where necessary to control the magnitude of the internal gaps and to minimize spiralling of the shade.
Figure 3B:
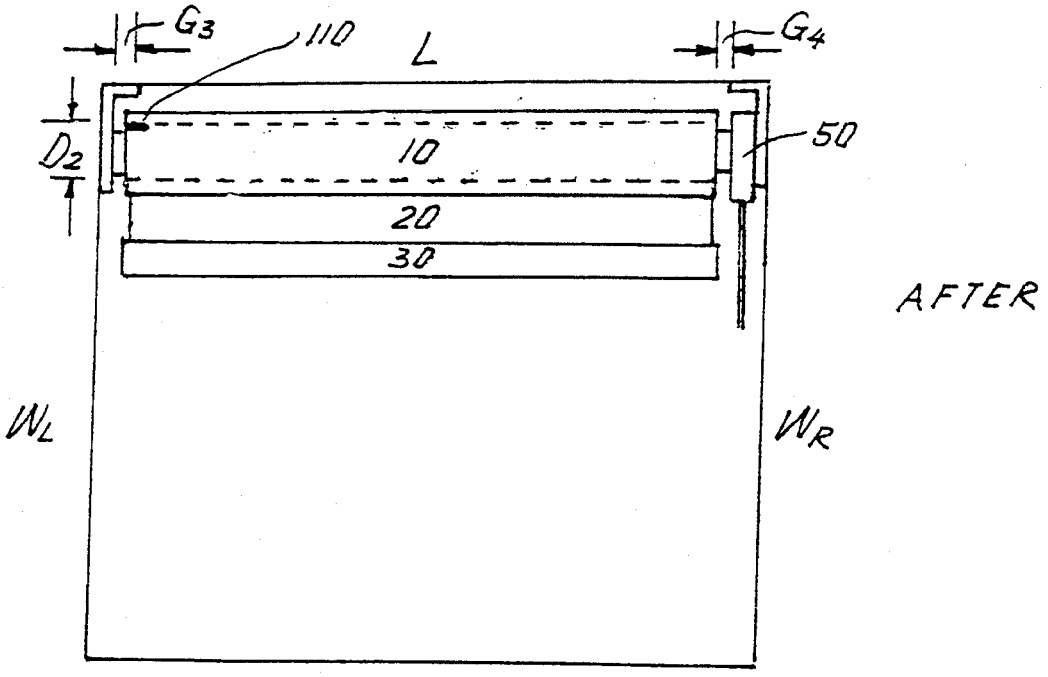
Figure 4:
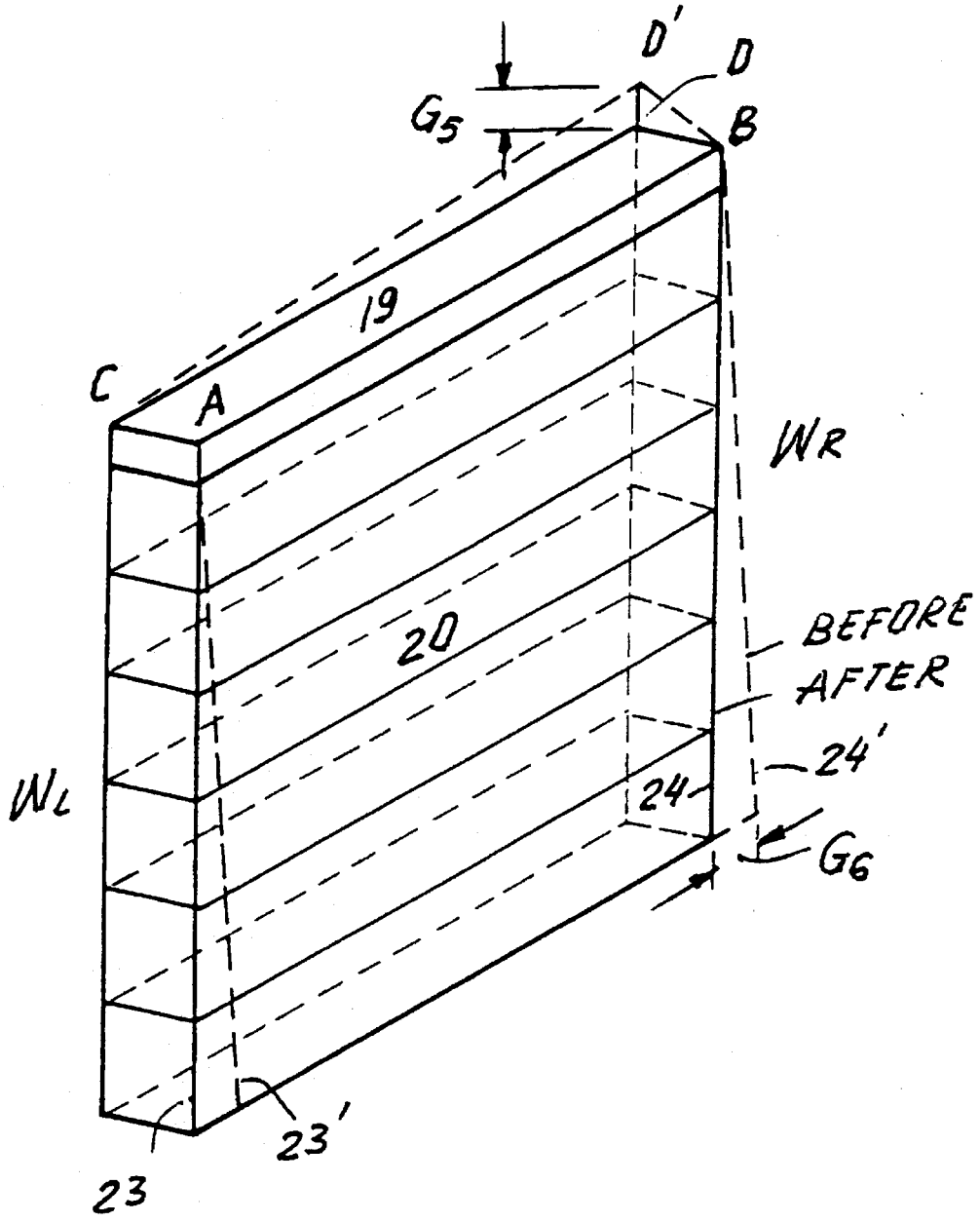
FIG. 4 is a diagrammatic perspective view of an window opening with a shade system inside showing the advantages of the third adjustment procedure namely a torsional adjustment of the housing of the shade in order to control the magnitude of the external gaps.

However a new problem emerges when gap $G_4$ becomes smaller and smaller as a result of spiral rolling of shade 20 on roller 10 when shade 20 is being rolled up. Typically, internal gap $G_4$ that is on the side of roller actuating mechanism 50 can easier create a problem than gap $G_3$, both being rather tight, but tolerance for gap $G_4$ is about one-half the size of tolerance for gap $G_3$. FIG. 1 demonstrates the result of the further adjustment procedure that corrected the spiral rolling of the shade by locally increasing the effective diameter of the roller 10 from $D_1$ to $D_2$ by use of clip 100 attached to axial extension 11 of roller 10. As a result, shade 20 is in the new, corrected position represented by edges 21*c* and 22*c*. The sizes of external gaps $G_1$ and $G_2$ as well as external gaps $G_3$ and $G_4$ are now acceptable during the entire rolling process of shade 20. The final refinement of the gaps $G_1$, $G_2$, $G_3$, and $G_4$ can be accomplished by finding a best possible position for the differential weight 33 of the low bar 30. Weight 33 is kept in the desired positions by locks 34. The inventor found the use of differential weight 33 as a single device to correct a typical geometric fit problem of the Silhouette shade to be generally insufficient and ineffective. However, it is a helpful device when combined with additional devices as set forth hereinbelow:

FIGS. 2–4 demonstrate in a schematic way, the three main conceptual ideas of geometric fit adjustment of the Silhouette shade, some of which are applicable to other window covering systems as well. These three ideas are labeled as the Procedures A, B and C, respectively.

Figure 2A:
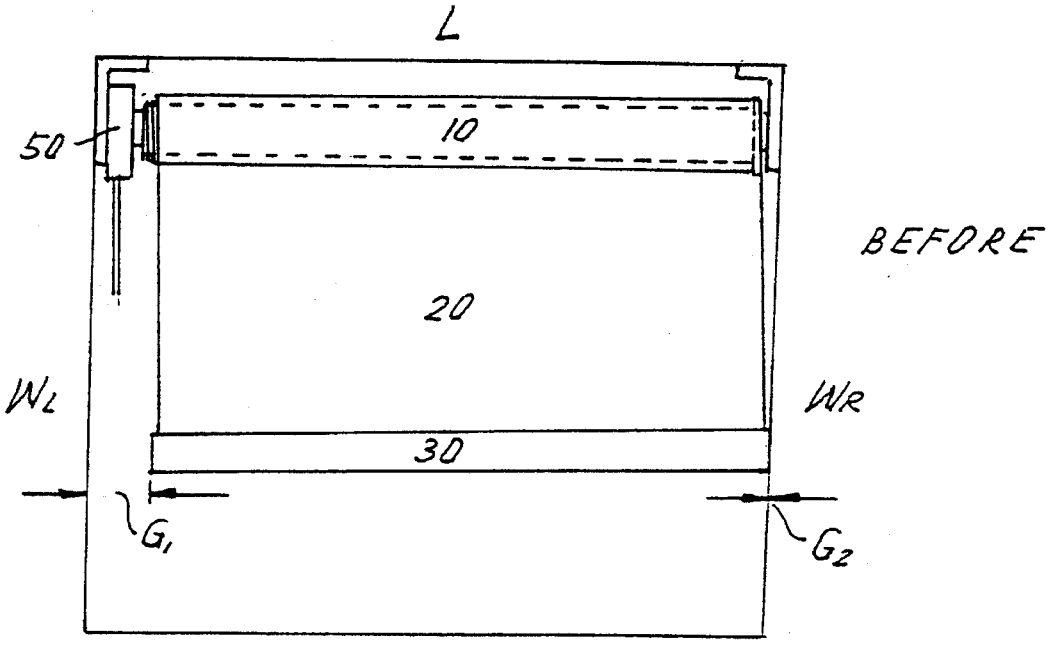
FIGS. 2*a* and *b* are diagrammatic front views of a Hunter Douglas Silhouette shade showing the advantages of the first adjustment procedure namely the reversal of the shade actuating mechanism from one end of the roller to another.
Figure 2B:
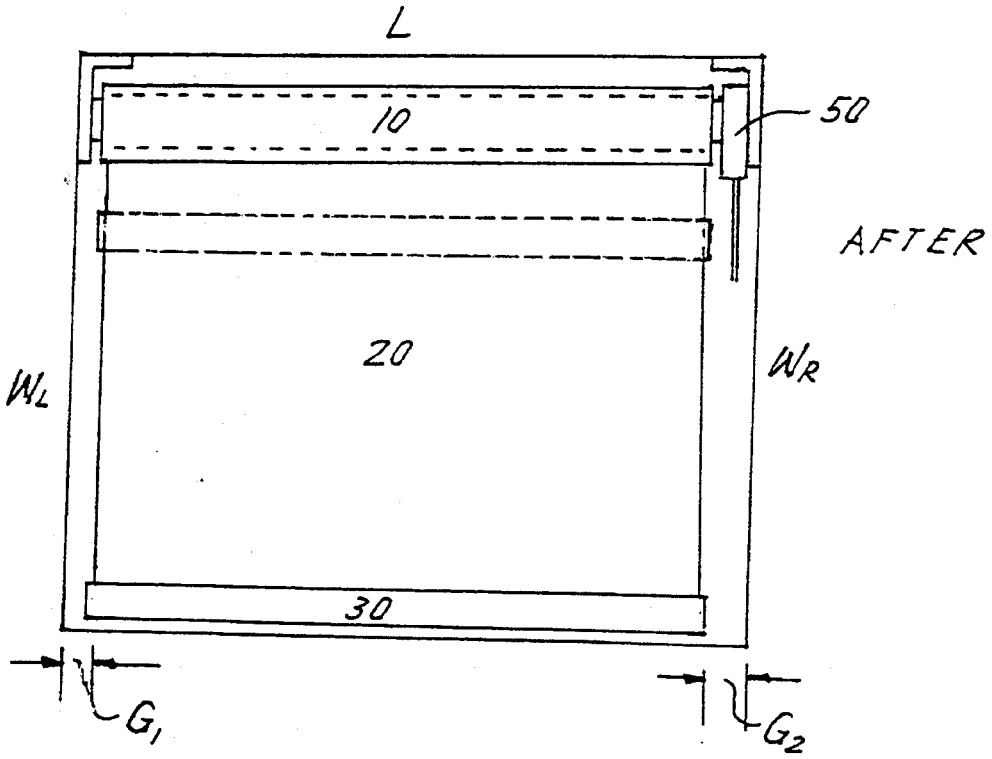

FIGS. 2*a* and 2*b* illustrate the effect of Procedure A which is reversal of the roller actuating mechanism 50 from left to right (or vice versa). The result of such procedure is generally control of external gaps $G_1$ and $G_2$ during the rolling process, (and to some extent also control of internal gaps $G_3$ and $G_4$, as shown in FIG. 1).

There are two main advantages of Procedure A. First, an extra gap is provided to the 'correct' side of the window (FIG. 2*b*), as roller actuating mechanism 50 makes the shade assembly asymmetrical. Second, by reversing mechanism 50 from one side (FIG. 2*a*) to another (FIG. 2*b*), a complex system of forces and moments acting on the shade system is altered and a slight desirable angular adjustment of shade 20 results.

FIGS. 3*a* and 3*b* illustrates the effect of Procedure B which is a modification of the rolling process by altering effective radius of rotation of the roller wherever necessary. In the case of the Silhouette shade, Procedure B primarily controls the magnitudes of the internal gaps $G_3$ and $G_4$, but external gaps $G_1$ and $G_2$ are clearly also affected by this procedure. Procedure B can be applied for any system that involves a roller. Applying a device such as 110 effectively helps to control spiral rolling when the shade is rolled up. In the case of Silhouette shade, rolling of shade 20 up can be very difficult once one of the internal gaps becomes zero (e.g. $G_4$=0, FIG. 3*b*); it can even result in damaging of the edge of fabric of shade 20. After Procedure B is applied, problems with gaps $G_3$ or $G_4$ are eliminated (FIG. 3A).

Procedure B can be used jointly with differential weight systems, but it is very effective alone if proper devices, discussed herein below, are applied.

FIG. 4 illustrates the main idea behind the adjustment Procedure C which is torsional adjustment of a head rail 19 of any window covering system similar to shades or blinds that is permanently attached to the window lintel L (rather than to side walls W of the window opening). Due to a variety of reasons (such as a non-horizontal position of the lintel plane itself), vertical edges 23 and 24 of the shade 20 may not fit into the window opening in the wall or, at least, result in an undesirable effect of non-parallelness between shade 20 and the window wall edges $W_L$ or $W_R$.

The head rail 19 (or in the case of Silhouette Shade system, central housing 90) needs to be adjusted. The obvious restriction is that edge AB of head rail 19 cannot be altered as it would create some unacceptable gap between the top of head rail 19 and lintel L to which rail 19 is permanently attached. However dropping point D' to a new position D creates an invisible vertical gap $G_5$ that is causing shade edge 24' to take a new angular position 24, (in similar way edge 23' becomes edge 23) that creates an horizontal shift $G_6$ by displacing point E' into E at the bottom of the shade 20. This way, the only point that needs to be altered is point D, not seen from the front on one end of the head rail 19; points A, B and C remain all in their original positions. Therefore, head rail 19 needs to be torsionally adjusted so that original point D' takes a new position D that needs to be secured by means of some devices that would prevent reactive forces in head rail 19 to bring it back to its original position.

In the case of Silhouette shade, this procedure was found by the inventor to be very effective in controlling the magnitude of the external gaps $G_1$ and $G_2$, see FIG. 1. Details of the adjustment of the Silhouette shade using Procedure C will be given in one of the following sections of this document. Generally, in the case of Silhouette shade, Procedure C effectively changes the entire geometry of the shade assembly that results in shifting the position of the rotating axis of the roller 10. Thus, the rolling process is altered in a desirable fashion and external gaps $G_1$ and $G_2$ can be effectively controlled throughout the process of rolling shade 20 up or down.

Figure 5:
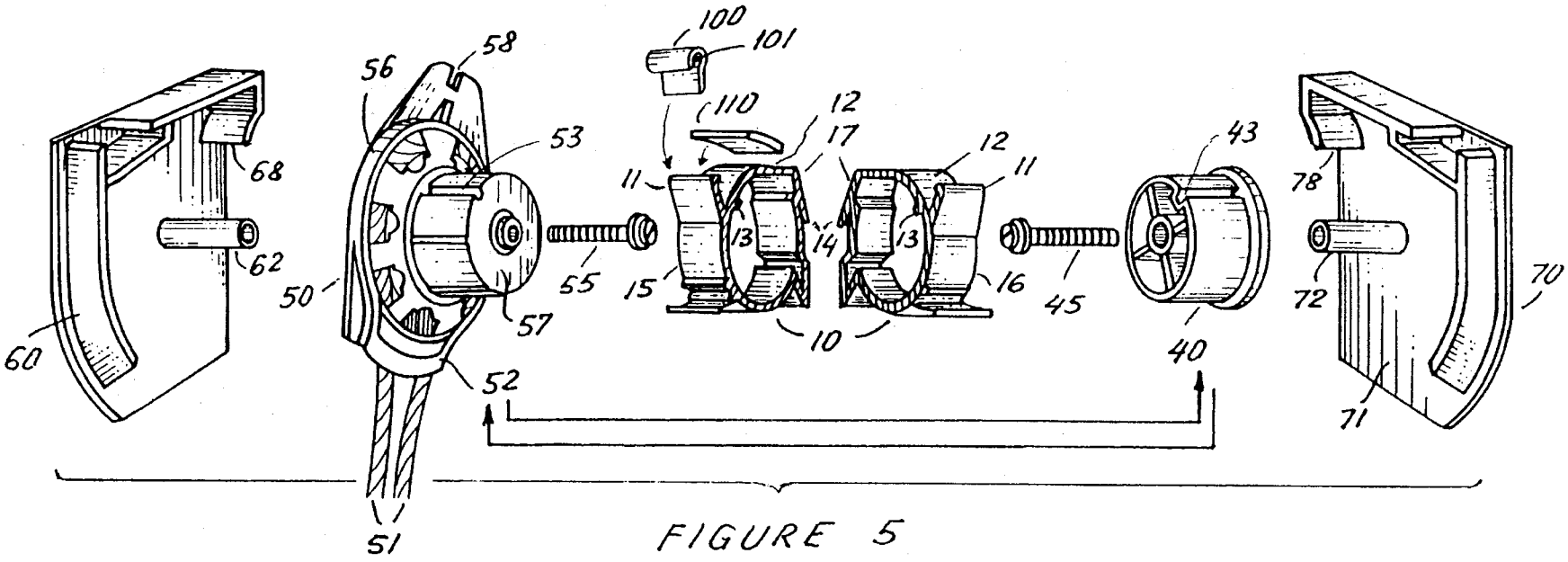
FIG. 5 is an exploded view of the mechanism of a Hunter Douglas Silhouette shade, showing the reversal of the shade actuating mechanism from one end of the roller to the opposite end and the installation of further modifying devices.

B. Detailed description of Procedure A: Reversal of the position of roller actuating mechanism from one side to another FIG. 5 illustrates the roller part of the Hunter Douglas Silhouette shade assembly that incorporates a relatively complex extrusion as a central roller, sections of which are indicated as 10. A left end plate 60 and right end plate 70 define the ends of the shade assembly; left and right end plates 60 and 70 will be seen to be mirror images of one another.

End plates 60 and 70 include central cylindrical bosses 62 and 72 to which a roller actuating mechanism 50 and opposite roller end plug 40 are secured by means of screws 55 and 45. Both roller actuating mechanism 50 and end plug 40 are provided with axial keyways 53, and 43. Keyways 53 and 43 cooperate with key 13 formed within the interior of roller 10. Roller actuating mechanism is a clutch with a non-movable part 56 and movable part 57 activated by cord 51. Non-movable part 56 is secured in its position by means of keyway 58 that cooperates with key 68 of left end plate 60. Roller end plug 40 rotates together with roller 10 and movable part 57 of roller actuating mechanism 50.

Shade 20 (not shown in FIG. 5; see FIG. 1) is attached to roller 10, and it is rolling on roller 10 when shade 20 is rolled up manually by the means of cord 51. Space available for shade 20 during the rolling process is limited by the internal face 52 of roller actuating mechanism 50 on one side and internal face 71 of right end plate 70 on the other side. Thus, assembling roller 10 with roller actuating mechanism 50 on left side instead of assembling it on the right side determines in a unique way the geometry of both external gaps $G_1$ and $G_2$ as well as internal gaps $G_3$ and $G_4$ (see FIG. 1) within any specific window opening which is commonly geometrically imperfect. Reversal of roller actuating mechanism 50 and roller end plug 40 creates a new geometry of the shade 20 within the window opening. If the position of the shade 20 before the application of Procedure A was assessed as "poor fit", the reversal of roller actuating mechanism 50 from one side to another should normally bring a significant improvement of the fit problem. This is primarily because the "poor fit" often results from adding several errors (in the shade, in the window opening) of the same sign together. After Procedure A is applied, a satisfactory fit can be accomplished despite the fact that both the shade and the window opening still remain geometrically 'imperfect': the overall error will now be the difference rather than the sum of the original geometric errors.

Normally, Procedure A provides both lateral and angular adjustment of the shade. It brings alteration of the previous system of forces and moments acting on the roller. As shade 20 tends to roll tighter on the side of roller actuating mechanism 50 than on the side of roller plug 40, some angular adjustment normally results from applying Procedure A. A lateral adjustment results from the fact that the Silhouette shade is asymmetrical: roller actuating mechanism 50 is wider than plug 40; also tolerances for internal gaps $G_3$ and $G_4$ are not even but in proportion 2:1 in favor of the gap on the side of the roller end plug 40.

Application of Procedure A is easy and fast. First, the shade assembly needs to be removed from the window then, roller part of Silhouette needs to be disassembled. Roller actuating mechanism 50 needs to be installed upon the right end plate 70, and connected with end 16 of roller 10, see FIG. 5. Keyway 58 will now cooperate with key 78. Screw 55 needs to be used for this installation. Consequently, roller end plug 40 needs to be assembled with left end plate 60 by the means of screw 45 and connected with end 15 of roller 10. Central housing 90 (not shown in FIG. 1 for clarity) will be assembled together with end plates 60 and bold 70, after which the Silhouette is ready to be put back to the window.

FIG. 1 shows also clip 100 and pad 110. Neither of these devices is related to Procedure A. Their role and function are explained in the next section.

Figure 6:
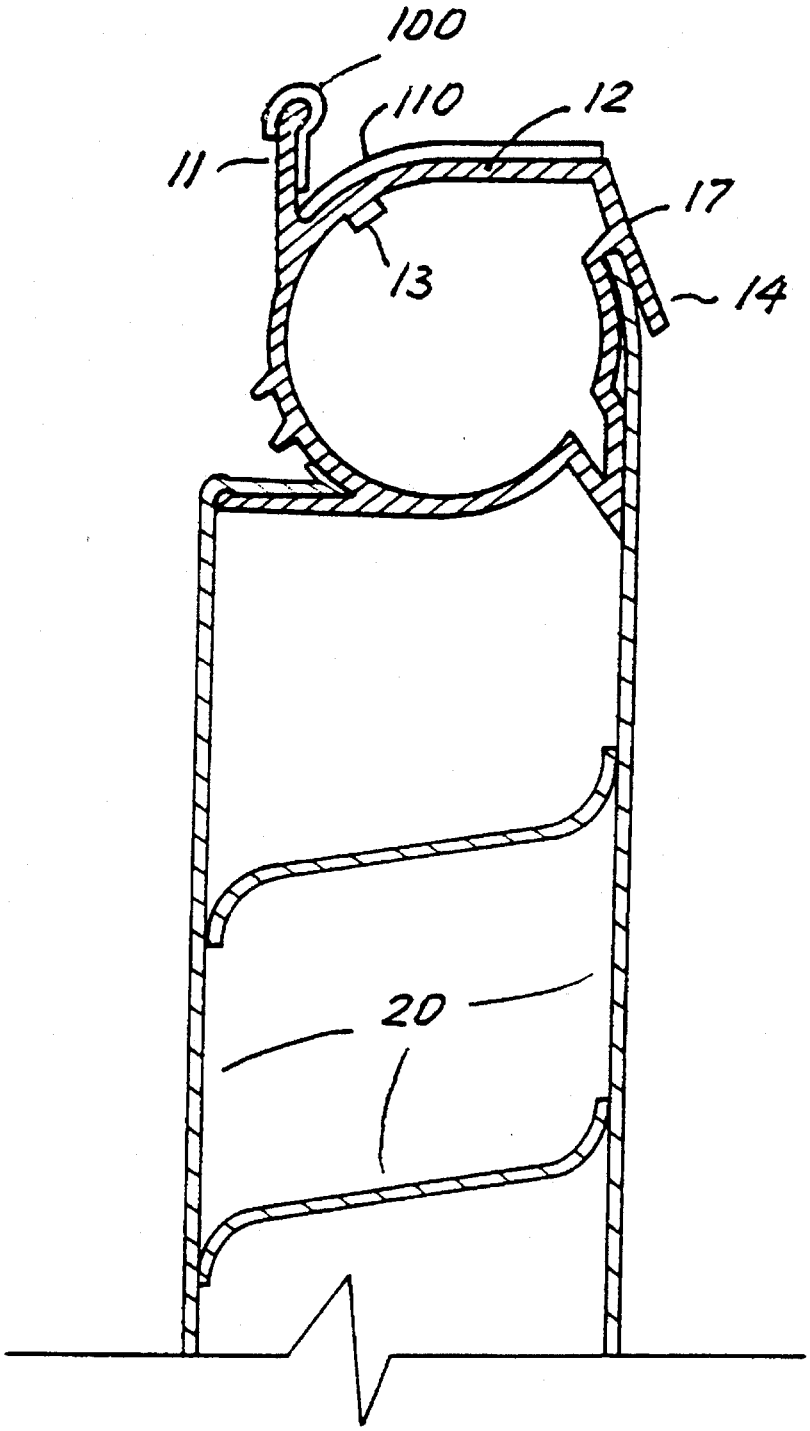
FIG. 6 is a cross sectional view of a Hunter Douglas Silhouette shade, showing the installation of devices serving to vary the effective roller diameter.

C. Detailed description of Procedure B: Controlling shade rolling process by local adjustment of the effective radius of rotation of the roller At times it will be found that the reversal of the actuating mechanism 50 from one end 15 to the opposite end 16 of roller 10, is insufficient to compensate for other window or shade imperfections. Accordingly, additional adjustment means may be used, either separately from the means discussed above, or in addition to that means. Such additional means are shown in FIGS. 1, 5, and 6. These means operate on the principle that the edges of a planar rectangular sheet rolled upon a perfectly cylindrical roller, will maintain congruent overlapping alignment as the sheet is rolled upon the roller. However, if the roller is not perfectly cylindrical it will be seen that a sheet rolled thereupon will be skewed or will spiral toward the end of the roller having the larger diameter. This effect is of course multiplied many times as the sheet is wound about the roller, resulting in a relatively large offset of the sheet. Such an effect is generally not desirable as it can lead into unacceptable angular bias of the shade within the window opening. Of course, the roller can take any geometric shape but each roller can be represented by an effective radius of rotation R or diameter D.

In the case of Silhouette shades, imperfect rolling may make edges 21 and 22 of the shade 20 not parallel to the respective edges of the window wall. Also, the position of low bar 30 may be crooked and non-horizontal when shade 20 is rolled up. In a more severe case, spiral rolling of shade 20 on roller 10 can cause a situation where one of the internal gaps $G_3$ or $G_4$ becomes zero with potential of damaging the fabric of shade 20 when a forced rolling up is imposed on the shade assembly.

Procedure B controls the rolling process, and can be used in the two major applications. The first application intends to eliminate spiral rolling and keep internal gaps $G_3$ and $G_4$ virtually constant throughout the rolling process. The second application intends to allow some spiral rolling to occur if that was to benefit the overall fit of shade 20 within a specific, and often geometrically imperfect, window opening. Several window covering systems, among them Hunter Douglas Silhouette shade, use the concept of differential weights to provide an angular adjustment of shade rolling. FIG. 1 shows weight 33 the can be shifted from left to right or vice versa in order to angularly adjust rolling of shade 20 on roller 10, as needed. The inventor has found this device to have limited applicability and effectiveness. What is proposed, instead, is a system of devices that alter the effective radius of rotation R of roller 10 wherever needed in order to provide and angular adjustment of the rolling process in a direction required, and to an extent needed. Radius-altering devices are very simple, and can be used separately or together with other devices or procedures (such as Procedure A). They can also be used jointly with differential weight systems such as 33, with very good results.

The main idea of adjustment Procedure B is best presented in FIG. 3. Increasing the effective radius of rotation and consequently effective diameter of the left side of the roller 10 from $D_1$ to $D_2$, may virtually eliminate spiral rolling on the left side, altering both internal and external gaps in a desirable way.

Procedure B can be applied to any roller-based window covering systems or to other systems not related to window covering such as roller-based screens, or similar. The main idea is to provide an asymmetrical modification of the effective radius of rotation to a specific place of roller 10. Sometimes the best effect can be accomplished by several modifying devices placed on roller 10 put in such places that bring the best overall effect.

There are several ways in which modification of the effective diameter of rotation can be made. Increasing diameter on one side is obviously much easier than decreasing diameter on the opposite side. The goal of this invention was to find the most flexible, inexpensive and effective devices aimed at altering the effective radius of rotation R that can primarily be applied in the Hunter Douglas Silhouette shade system, but also elsewhere.

FIGS. 5 AND 6 show that the specific extrusion shape of roller 10 of the Hunter Douglas Silhouette shade includes axial extensions 11 and 14. Extensions such as 14 are provided for securing a shade 20 thereto, and/or providing separation for the components of shade from one another. Additional details, such as axial ridges 12 or 17 are also provided. These extensions 11 and 14 and ridges 12 and 17 may be used to advantage to modify the effective diameter D of roller 10. If, for example, it is desired to increase the effective diameter of the left end 15 of roller 10 in order to cause the associated shade to skew or spiral toward the left side of the roller 10 (and therefore the window opening in which roller 10 is installed), clips 100 may be installed upon axial extension 11 (or 14) toward the left end 15 of roller 10. As the effective diameter $D_1$ of roller 10 is at least partially determined by outward extensions such as 11, it will be seen that the addition of a clip 100 extending further outward from an extension 11 will serve to increase the effective diameter of at least that end 15 of roller 10 to a new diameter $D_2$. The resulting difference in effective diameters $D_1$ and $D_2$ as shown in FIG. 1 will result in a shade 20 wound thereupon closer to the left end 15 than it did before applying clip 100. While the left edge **21*b* of such a shade 20 would ordinarily lie in a plane perpendicular to roller 10, the addition of a clip or clips 100 to extension 11 or 14 increase the effective diameter of the left end 15 of roller 10 to a diameter $D_2$ will also be seen to provide a left edge 21*c* for shade 20 which is displaced further leftward. This intentional displacement of the edge 21 of shade 20 may be used to advantage to cause a shade 20 to more closely align with the sides of a window opening $W_L$ or $W_R$ in which such a shade 20 and associated mechanism may be installed. This procedure can, therefore, effectively control magnitudes of external gaps $G_1$ and $G_2$ throughout the rolling process of shade 20 on roller 10**.

A more common application however, for which Procedure B is primarily designated, is a process of correcting spiral rolling of shade 20 on roller 10, so that internal gaps $G_3$ and $G_4$ can be effectively controlled to remain virtually unchanged during the entire process of rolling shade 20 up. Due to the shape of extension 11, clips 100 may be provided with a cooperating slot 101 which can be frictionally installed over extension 11, in the desired location. A desired location of clip 100 on extension 11 of roller 10 can be easily maintained because of the reactive force from clip 100 acting on extension 11 of roller 10. It is important to note that movement of the one or more clips 100 from left to right is easy and thus a truly controlled, continuous adjustment of the effective radius of rotation is provided. The effect of the adjustment of the effective radius of rotation gradually diminishes as clip 100 is moved from left side 15 of the roller 10 toward its center. When clip 100 is moved to the right side 16 of the roller 10, the sign of the result of adjustment is reversed, i.e. shade 20 would get skewed toward right rather than toward left as it was before.

Alternatively, clip or clips 100 may be adhesively secured to extension 11, or in the event that roller 10 is formed of a ferrous metal, clip or clips 100 may be magnetically secured thereto. Preferably, the attachment means used to secure clip or clips 100 to axial extension 11 allows for an easy relocation of clip or clips 100 in order to provide for fine adjustment of the resulting variation in the edge position 21 of a shade 20. Axial extension 11 appears to be a more convenient location for clip 100 than extension 14.

A variation on the above means is provided by diametric pads 110. Pads 110 may be adhesively (or magnetically, if such means is applicable) secured to roller 10, preferably at areas providing the greatest effect such as along axial ridge 12 or 17. The principle of operation of diametric pads 110 will be seen to be identical to that of clip 100, in that both serve to increase the effective diameter of that portion of the roller 10 to which they are secured. Pads 110 can take variety of geometric shapes such as buttons, knobs etc., all serving the same function of increasing the effective radius of rotation of roller 10. Multiples of clips 100 and/or pads 110 may be used to provide a larger effective diameter if needed, and clips 100 and pads 110 may be used together if desired or needed. Clips 100 of varying thickness may be provided, one of which is selected to satisfactorily accomplish the required adjustment.

Figure 7:
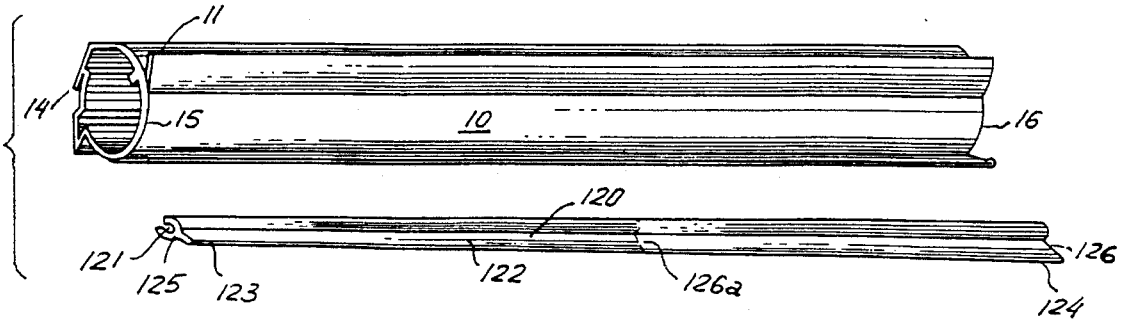
FIG. 7 is a perspective view of a Hunter Douglas Silhouette shade roller, showing additional means providing for the adjustment of the effective diameter, or rather, the effective radius of rotation of the roller.
Figure 8:
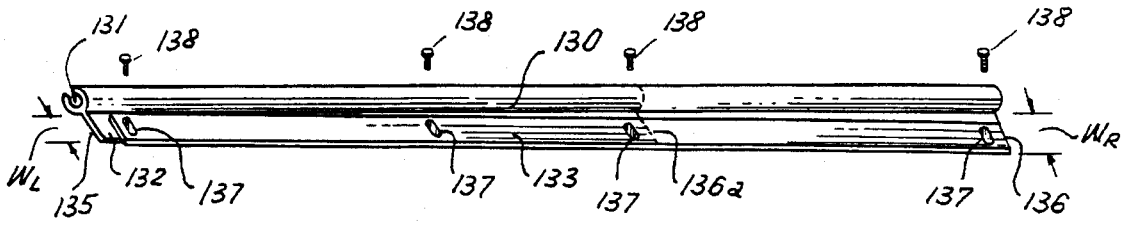
FIG. 8 is a perspective view of an alternative means of adjustment of the roller effective diameter.

Additional means providing for the variation of effective diameter D of a roller 10 are shown in FIGS. 7 and 8. Clips 100 solve the problem in almost every instance, it has been found, two of such clips 100 being all that is necessary. Two clips 100 can be put on the opposite sides 15 and 16 of the extension 11 of roller 10 as a standard starting position. After shade 20 is placed into a window opening, positions of both clips 100 can be adjusted to such locations along extension 11 of roller 10 that optimize the objective adjustments set forth e.g. controlling internal gaps $G_3$ or $G_4$ versus external gaps $G_1$ or $G_2$. The inventor found such a process to be fast, easy and highly effective.

However, it might be desirable under some circumstances to provide a constant and uniform variation in effective diameter from the left end 15 to the right end 16 of roller 10. This may be accomplished by means of roller extension blade 120. Extension blade 120 will be seen to include a slot 121, which slot 121 is formed to closely cooperate with roller extensions 11 or 14 of roller 10. An outwardly extending blade 122 is provided opposite slot 121.

Blade 122 has lesser outward extension 123 to the left end 125 of extension blade 120, and a greater outward extension 124 to the right end 126 of blade 120. However, ends 125 and 126 of blade 120 can easily be reversed. If this was done, a greater extension 124 would be at the left end 15 of roller 10, and a lesser extension 123 would be at the right end 16 of roller 10. The resulting effect would be then similar to the effect of clip 100 of pad 110 being located on the left side of the extension 11 of roller 10, as in FIG. 1.

In the case of all of the blades disclosed in FIGS. 7 and 8, the length may be shortened as indicated by phantom line 126*a*. Such a modification of blade 120 offers an extra adjustment opportunity as blade 120 can now be moved from left to right along the extension 11 of roller 10 in a search for the best possible effect on correcting the rolling process of shade 20 on roller 10.

Even with a modified, shorter length, blade 120 does not offer a complete flexibility of adjustment due to the monolithic construction of the extension blade 120. Alternatively, an adjustable extension blade 130 may be used, as shown in FIG. 8. Adjustable extension 130 is formed in a manner similar to that of blade extension 120, in that adjustable extension 130 also includes a longitudinal slot 131 to cooperate with roller extension 11 (or 14). However, adjustable extension 130 provides a separate blade 133 adjustably affixed to the body 132 of extension 130 by means of blade slots 137 and securing screws 138. Thus, securing screws 138 may be loosened and adjustable blade 133 positioned as desired, then screws 138 tightened to secure blade 133 in a fixed position relative to adjustable extension body 132. When installed upon a roller 10, adjustable extension 130 functions in the same manner as extension blade 120, serving to vary the respective widths on the left $W_L$ and on the right $W_R$ and, consequently, serving to vary the effective diameters of the left end 15 and the right end 16 of a roller 10 to which adjustable extension 130 is attached. Adjustable blade 133, spans between ends 135 and 136 of blade 130, but can also ba shortened as indicated by phantom line 136*a*, for an extra adjustment opportunity along extension 11 of roller 10 to search for a best possible control of the rolling of roller 10 to search for a best possible control of the rolling process of shade 20 on roller 10. Alternatively, separate extension blade 133 can be directly affixed to roller extension 11 (or 14) by means of blade slots 137 and securing screws 138. This would eliminate need for the first blade 132 of adjustable extension blade assembly 130.

Figure 9:
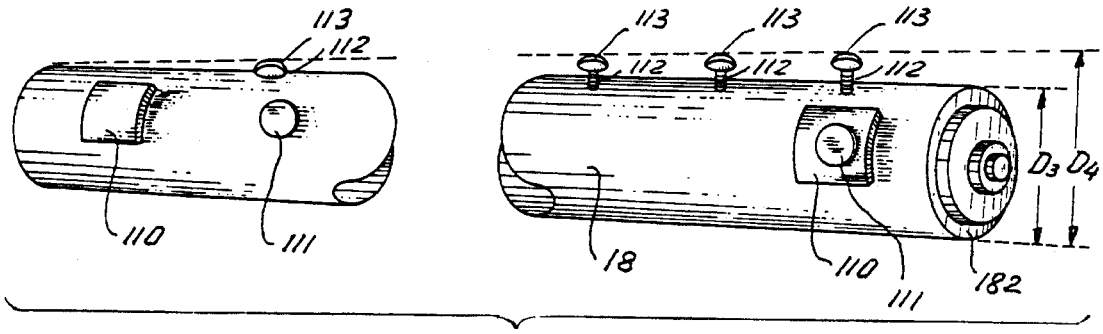
FIG. 9 is a broken perspective view of a standard spring wound shade roller, showing the application of further shade adjustment means thereto.

It is apparent that the variation in effective diameter between the opposite ends of a shade roller is a desirable means of achieving a uniform shade positioning within a window frame. However, to this point the only means of accomplishing this have been directed to the shade roller 10 specifically used with the Hunter Douglas Silhouette shade. FIG. 9 provides an exaggerated view of further means which are applicable to other types of shade rollers, such as the well known spring wound roller shade. It is apparent that the same adhesively secured pads 110 as provided for the variation of effective diameter of a Hunter Douglas Silhouette roller 10, may be used to vary the effective diameter of a spring wound roller 18. While such spring wound rollers 18 are normally made of wood or perhaps a plastic material, in the event such a roller were to be formed of a ferrous material such pads 110 could be magnetically secured. Other shapes may also be used in lieu of pads 110, such as the dots 111 disclosed in FIG. 9, and a plurality of pads 110 or dots 111 may be stacked in order to achieve the desired effect.

As such spring wound rollers 18 are normally constructed of wood or other relatively soft material, other means to achieve the desired difference in effective diameters become apparent. FIG. 9 further discloses the use of diametric adjustment screws 112 in such a spring wound shade roller 18. By installing screws 112 axially along a roller 18 with the screw heads 113 defining a straight and converging line to the central axis of roller 18, much the same effect is achieved as by the use of the other means for varying the effective diameter of a Hunter Douglas Silhouette shade roller 10 discussed above. In the example of FIG. 9, it will be seen that the relatively elevated screw heads 113 nearest the right end 182 of roller 18, serve to increase the effective diameter $D_4$ over the standard effective diameter $D_3$ of the shade roller 18 alone, thus providing the same benefits as discussed above in the modifications to the Hunter Douglas Silhouette roller 10. Preferably, screw heads 113 are relatively smooth in order to preclude damage to a shade secured to spring wound shade roller 18.

D. Detailed description of Procedure C: Controlling the magnitude of external gaps by a torsional adjustment of the central housing.

1. Procedure $C_1$: Angular adjustment of end plates

Figure 10:
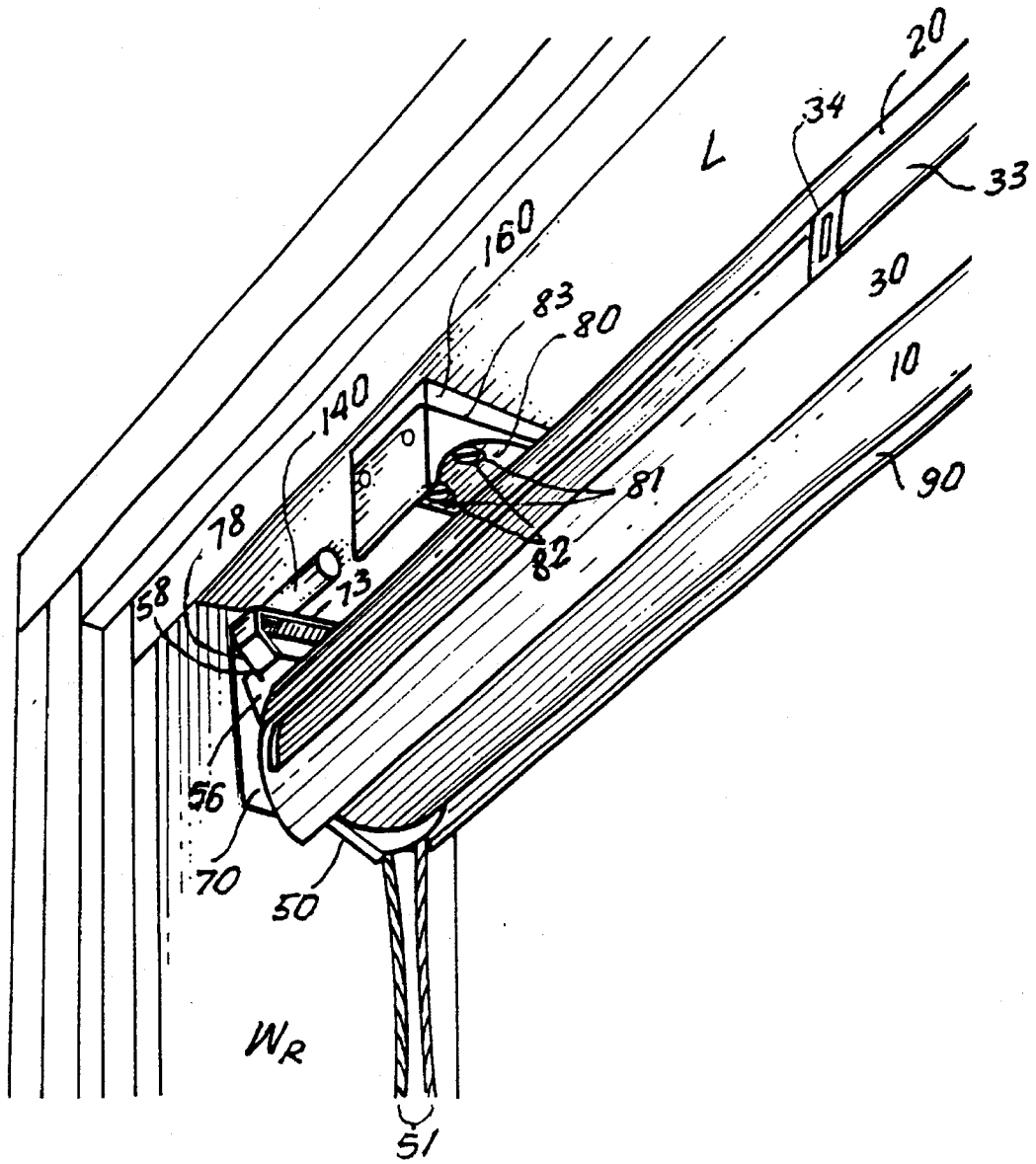
FIG. 10 is a perspective back view of the upper corner of a window opening with a Hunter Douglas Silhouette shade installed inside, showing the positions of the end plate and the shade mounting bracket as well as means providing for the torsional adjustment of the end plate, and consequently the shade central housing, in order to control the sizes of the external gaps between the shade edge and the wall.

Procedure B, as mentioned before, is primarily useful in controlling the magnitude of the internal gaps $G_3$ and $G_4$. In some instances, the main problem will be with the external gaps $G_1$ or $G_2$. This can be due to several reasons such as non-horizontal position of the lintel L, non-vertical position of wall edges $W_L$ or $W_R$, or some error in the shade itself. Even a small error in the first rotation of the shade will be multiplied many times when the shade is fully drawn down. Sometimes, one of the gaps $G_1$ or $G_2$ will become zero, making a normal use of the shade very difficult. The most effective adjustment that would solve the problem of controlling external gaps $G_1$ or $G_2$ would be the one that could effectively alter the position of the rotating axis by adjusting the position of roller 10 to better fit a specific window opening. The essence of the adjustments accomplished by Procedure C is identical to this illustrated by FIG. 4. FIG. 10 shows a perspective view of the back side of the right upper corner of the window opening with the wall $W_R$ and lintel L and the shade 20 rolled up onto roller 10 with low bar 30 in its extreme upward position. Differential weight 33 of low bar 30 is secured in its desired position by the means of lock 34. Roller 10 is attached (through the front central housing 90, not seen from the back) to lintel L by the means of mounting bracket 80. Right end plate 70 is secured to central housing 90.

The movable part 57 (not seen) of the roller actuating mechanism 50 is activated by cord 51, causing rotation of roller 10 and movement of shade 20 up or down. The non-movable part 56 of roller actuating mechanism 50 is secured in its position by the means of keyway 58 and corresponding key 78 of the right end plate 70. In its normal position, mounting bracket 80 is permanently attached to lintel L by the means of screws 82 that go through oval holes 81 in bracket 80. This way, there is no gap between the flange 73 of the right end plate 70 and lintel L.

FIG. 10 shows two devices able to alter the position of the axis of rotation A of roller 10, and consequently the angular position of shade 20. The first device is some form of wedge 140 inserted between the flange 73 of right end plate 70 (or between flange 63 of left end plate 60) and window lintel L, to maintain the gap between flange 73 of the right end 70 and lintel L. This gap is created by torsional adjustment applied manually to central housing 90. If the desired angular adjustment of the shade 20 is substantial, another wedge 160 is secured between the top 83 of mounting bracket 80 and lintel L. Wedge 160 is normally used together with wedge 140. Wedge 160 is needed when adjusting position of end plate 60 or 70 by means of wedge 140 alone is not able to bring the desired level of angular adjustment of shade 20.

Figure 11:
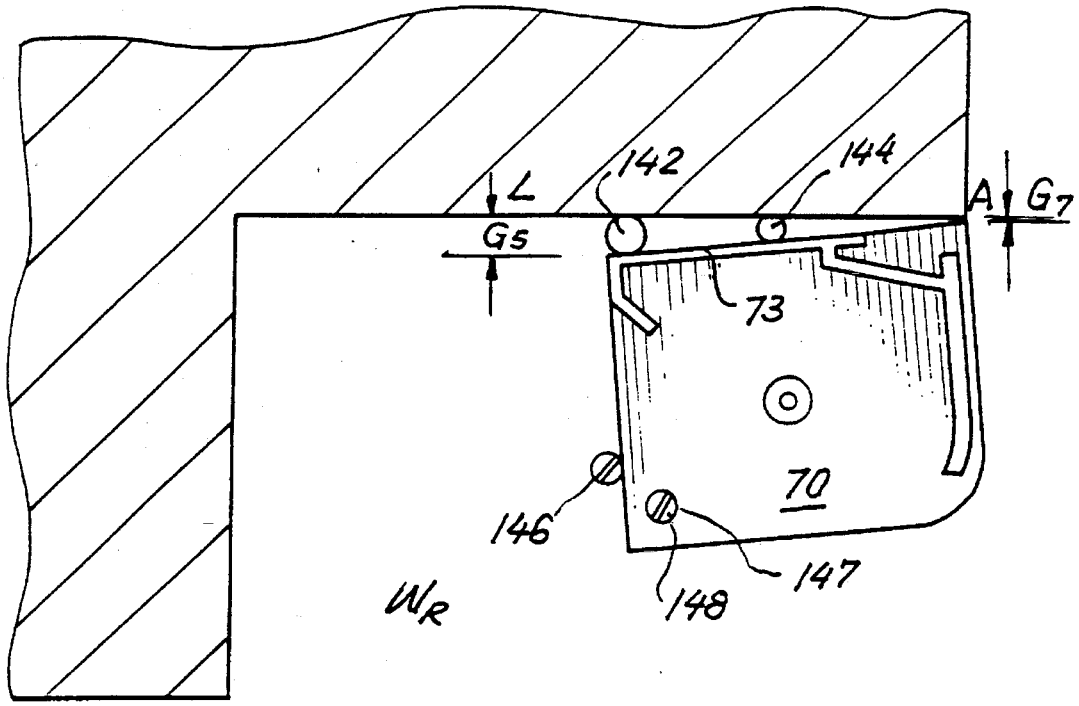
FIG. 11 is a side view of an end plate element of a Hunter Douglas Silhouette shade, showing means providing for the torsional adjustment of the end plate.

FIG. 11 discloses wedges 142 and 144 inserted between the flange 73 of a right end plate 70, and the adjacent lintel L. While the wedges 142 and 144 shown in FIG. 11 are of circular cross section, other shapes may be used also. The circular cross section of wedges 142 and 144 provide for ease of insertion between flange 73 and the adjacent lintel L. It will be seen that only one wedge 142 or 144 is needed to provide the necessary adjustment of end plate 70, but two are shown in order to make clear the point that various sizes may be provided and will serve the same function, depending upon the amount of angular variation and adjustment of space $G_5$ required. As noted above, any angular adjustment of either end plate 60 or 70 will affect the adjustment of roller 10, and thus shade 20, by means of the interconnecting housing bold 90 (not shown) between the two end plates 60 and 70.

An alternative way to maintain the torsionally adjusted position of central housing 90 (not shown) is to use screws 146 or 148 as anchors for end plates 70 or 60. Screw 146 is outside the adjusted end plate 70 whereas screw 148 requires hole 147 to be first produced on end plate 70. It is important to assure that gap $G_7$ is comfortably close to zero as it would otherwise produce an unsightly view at the front of the window.

Figure 12A:
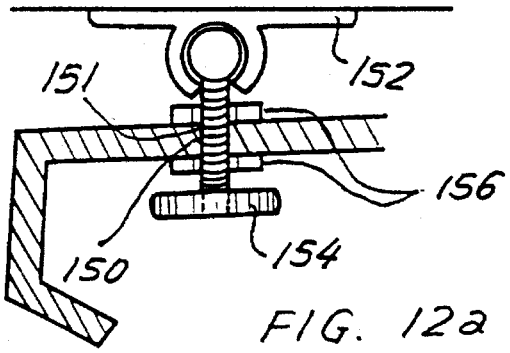
FIG. 12 is a side view similar to the view of FIG. 11, showing further torsional adjustment means.
Figure 12:
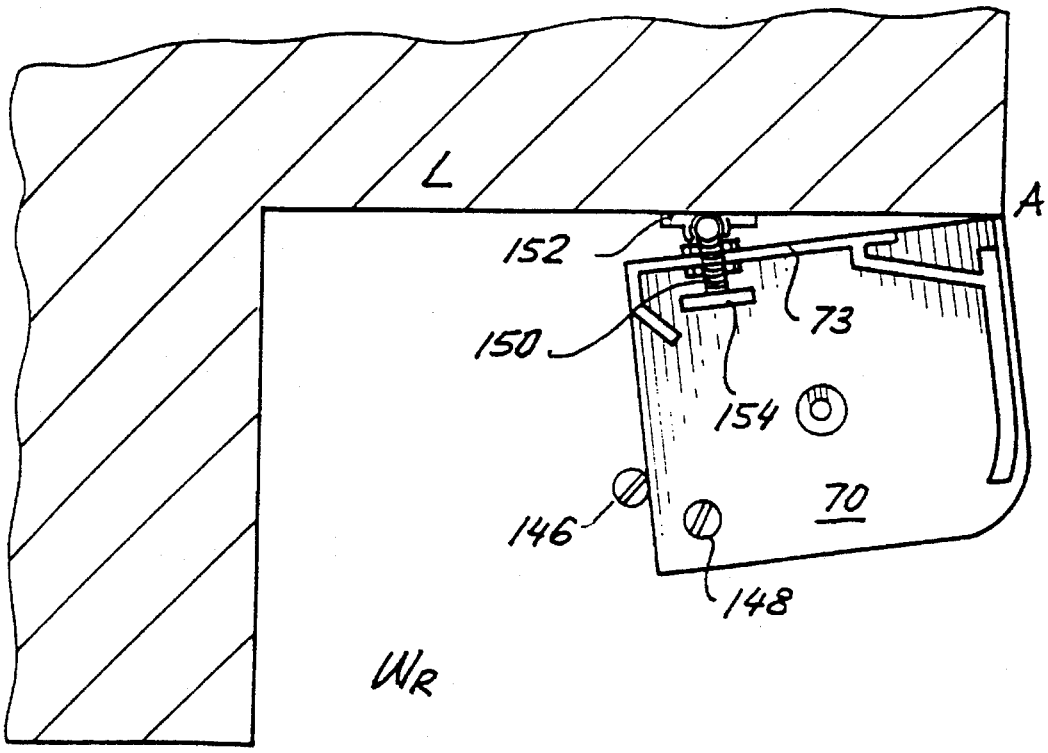

FIG. 12 shows yet another alternative for torsial adjustment of central housing 90 through an adjustment of end plates 60 or 70. A threaded hole 151 may be provided in the flange 63 or 73 of end plate 60 or 70, and an adjustment screw 150 provided therethrough. Adjustment screw 150 includes an angularly adjustable pad 152, and an opposite adjustment grip 154. Threading adjustment screw 150 inwardly or outwardly within flange hole 151 provides a continuous adjustment for end plate 60 or 70 (for details see FIG. 12*a*). Locking nuts 156 may be added to protect the adjusted position of plate 70 (or 60) from changing.

2. Procedure $C_2$: Angular adjustment of mounting brackets.

Figure 13:
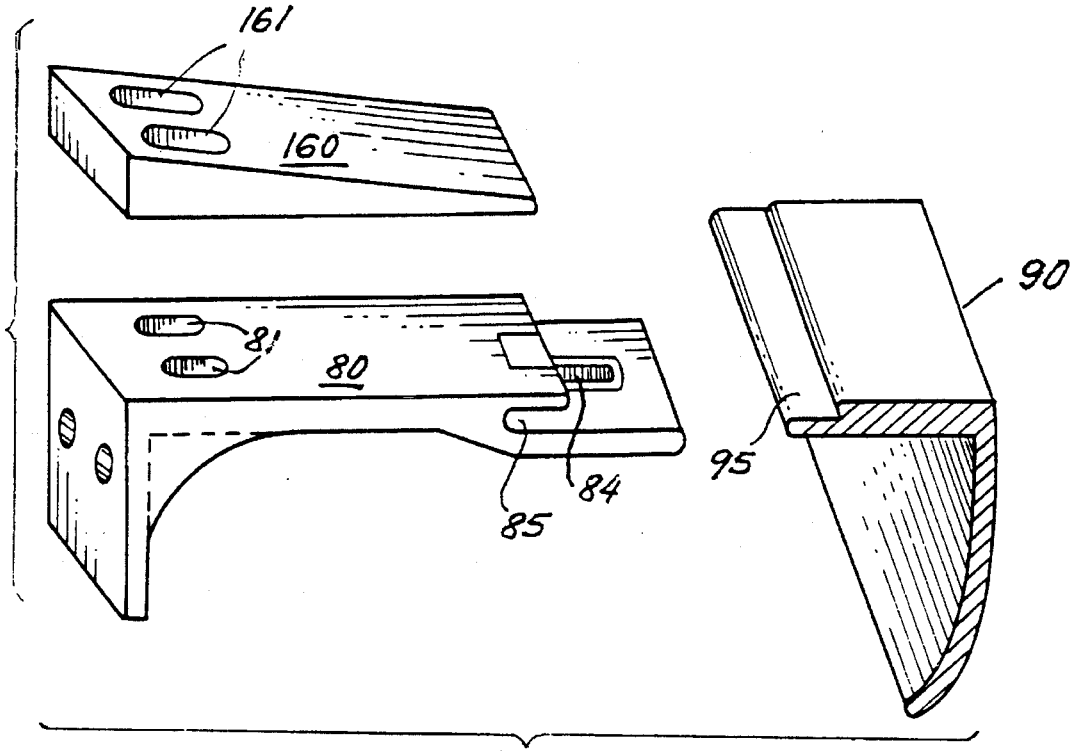
FIG. 13 is a perspective view of a shade mounting bracket including a wedge for the torsional adjustment of the bracket.
Figure 14:
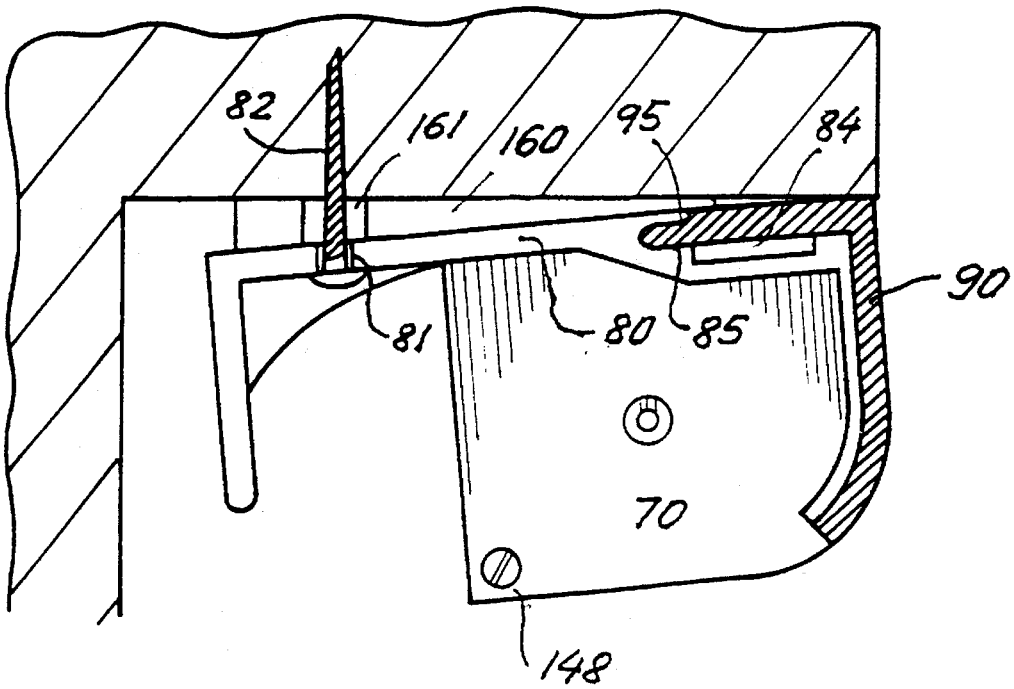
FIG. 14 is a side view of a bracket with a wedge as shown in FIG. 13.

As mentioned before, torsional adjustments of central housing 90 through angular shift of end plates 60 or 70 can effectively control magnitudes of the external gaps $G_1$ or $G_2$. However, there may be severe cases of deficiency in gap control adjustments that procedure $C_1$, described before may not be able to provide. In such cases, the very foundation of the Silhouette Shade assembly, namely mounting bracket 80 needs to be angularly adjusted, see FIGS. 13 and 14. Roller 10 of the Silhouette shade assembly is attached to end plates 60 and 70. End plates 60 and 70 are connected by the means of central housing 90. Central housing 90 is attached to mounting bracket 80 by means of a locking mechanism 84. Key 95 of central housing 90 fits keyway 85 of mounting bracket 80. Mounting bracket 80 is secured to lintel L by the means of screws 82 that go through holes 81. Angular adjustment of mounting bracket 80 is accomplished by wedge 160. Wedge 160 has oval, expanded holes 161 to allow moving wedge 160 from left to right to adjust, within limits, the magnitude of the angular adjustment of wedge 160. Angular adjustment of mounting bracket 80 should, normally, be accompanied by a corresponding angular adjustment of end plates 60 or 70, by any of the means previously recommended for such an adjustment, namely wedges 142 or 144 or screws 146 or 148. The idea is to keep gap $G_7$ at point A close to zero, for a proper visual effect at the front of the central housing 90.

Different versions of wedge 160 corresponding to varied magnitudes of the desired angular adjustments can be developed, so if a specific wedge 160 proves to provide an insufficient angular adjustment of the mounting bracket 80, a steeper wedge 160 can be used.

Figure 15:
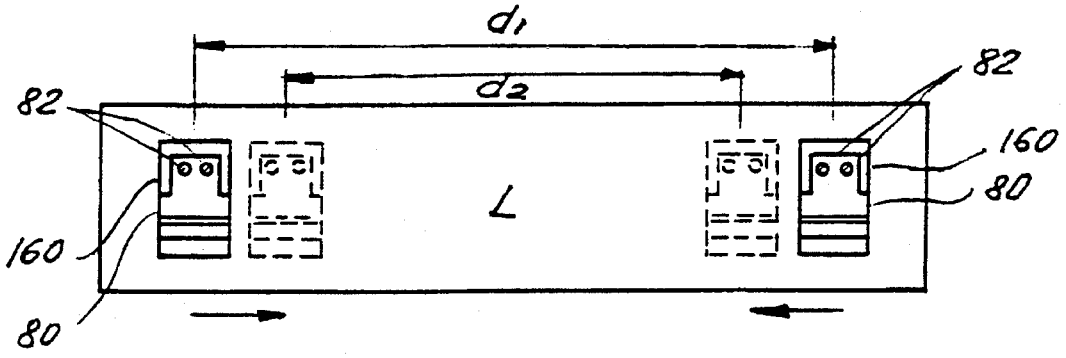
FIG. 15 is a look-up view of the window opening showing the way to increase the magnitude of the torsional adjustment of the shade central housing by shifting the positions of the shade mounting.

Another way to adjust the scale of the angular adjustment of bracket 80, is to reposition brackets 80 together with corresponding wedges 160 from their original positions, as shown in FIG. 15, to new positions marked by broken lines, located closer to the middle of the lintel L. Such a procedure requires unscrewing screws 82 from the old position on the Lintel L and using them to screw brackets 80 together with corresponding wedges 160 into a new position. As distance $d_1$ is reduced to $d_2$, such an adjustment increases the magnitude of the angular adjustment of mounting bracket 80, and consequently results in a more dramatic angular adjustment of shade 20. If such a procedure is applied, an extra adjustment of the corresponding end plate (60 or 70) will be needed in order to assure Gap $G_7$ to remain zero.

Figure 16:
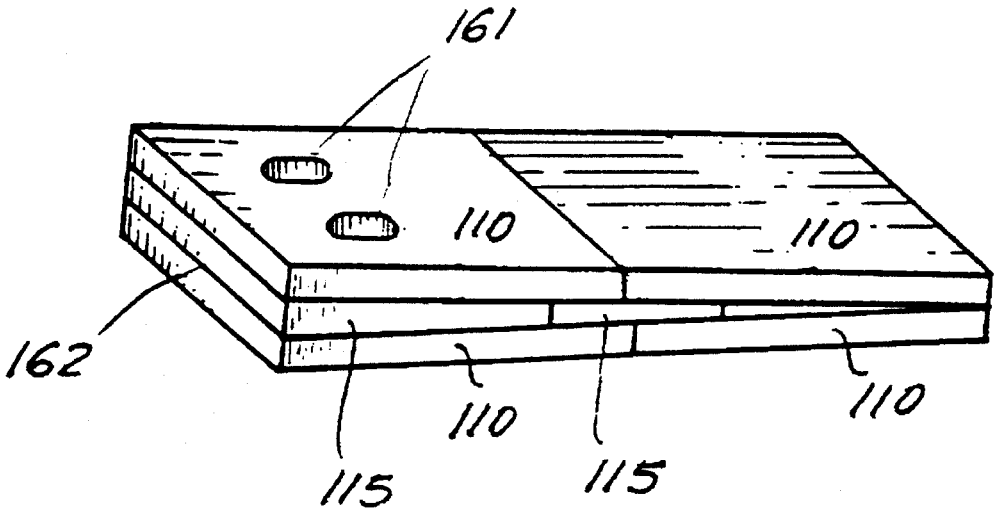
FIG. 16 is a perspective view of an adjustable wedge for the torsional adjustment of the bracket.

Wedge 180 can be produced in many ways. In order to accomplish an easy flexibility of magnitude of the angular adjustment of the mounting bracket 80, adjustable wedge 162 can be easily assembled from adhesive pads 110 and pad parts 115, as shown in FIG. 16. Different geometric combinations of pads 110 and pad parts 115 can be assembled to accomplish such a steepness of wedge 160 that produces a desired level of angular adjustment of shade 20. Oval holes 161 for screws 82 can easily be cut out in respective pads 110 or pad parts 115 as required. Elementary pads 110 and pad parts 115 can preferably be produced from flexible material allowing for an easy formation of the desired geometric shape of wedge 160.

Figure 17:
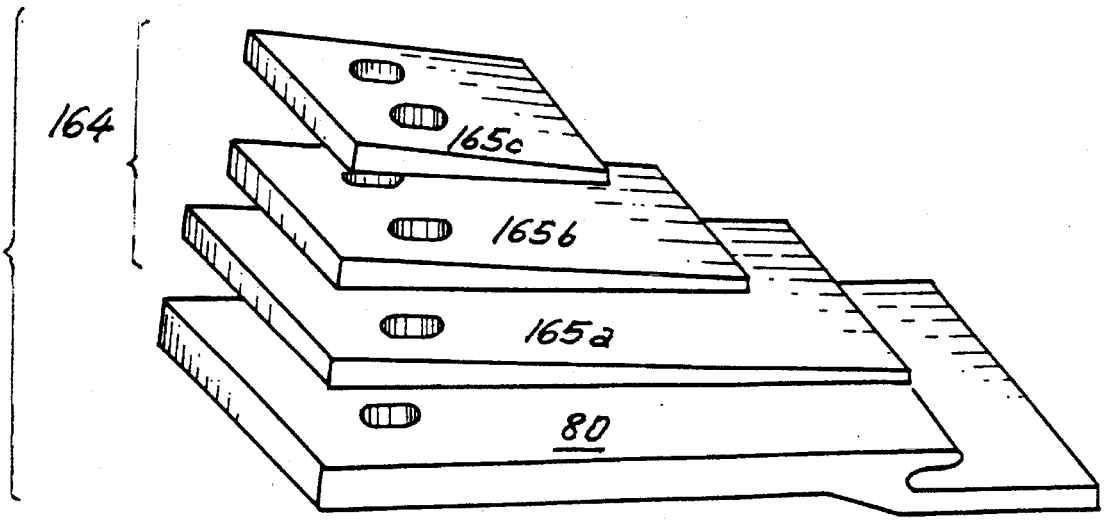
FIG. 17 is a perspective view of an alternative version of an adjustable wedge.

A variation of wedge 162 shown in FIG. 16 is wedge 164 shown in FIG. 17. Wedge 164 is assembled from a required number of elementary prisms of adhesive pads 165 *a, b, c*, etc. to produce a desired steepness of wedge 164.

Figure 18:
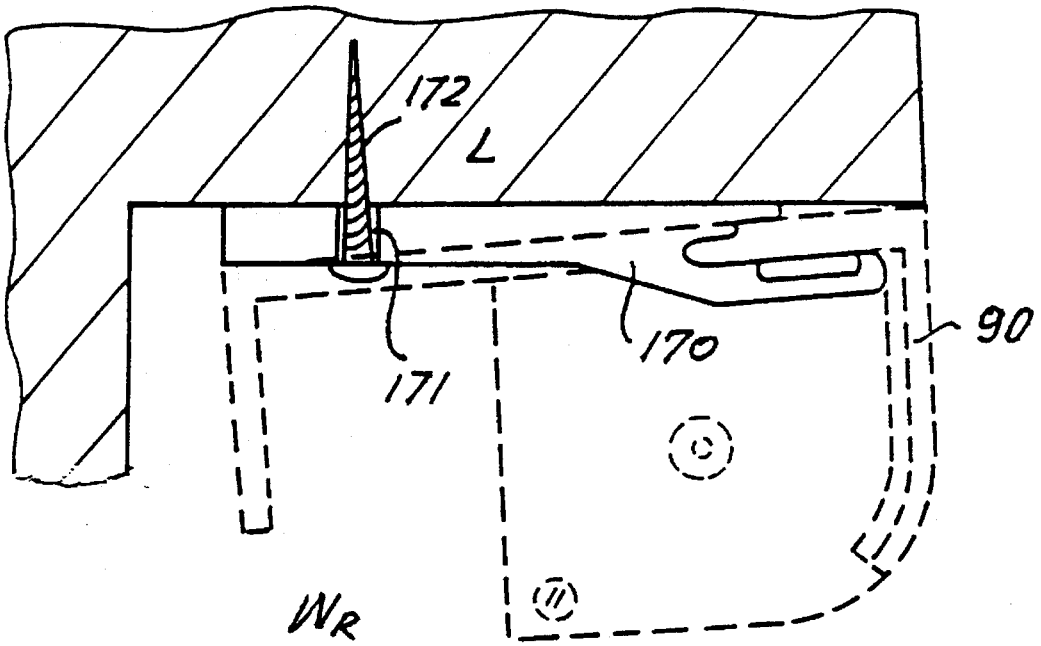
FIG. 18 is a side view of an alternative modified mounting bracket.

FIG. 18 shows a simple and effective device that is able to angularly adjust position of central housing 90 is a modified mounting bracket 170. Such a bracket has a modified geometric shape such that it eliminates the need for any wedge 160 but alone accomplishes the effect identical to the combination of bracket 80 and wedge 160. Modified bracket 170 can be designated in several versions corresponding to different magnitudes of the desired angular adjustments of central housing 90. Modified bracket 170 has holes 171 for screws 172.

Figure 19:
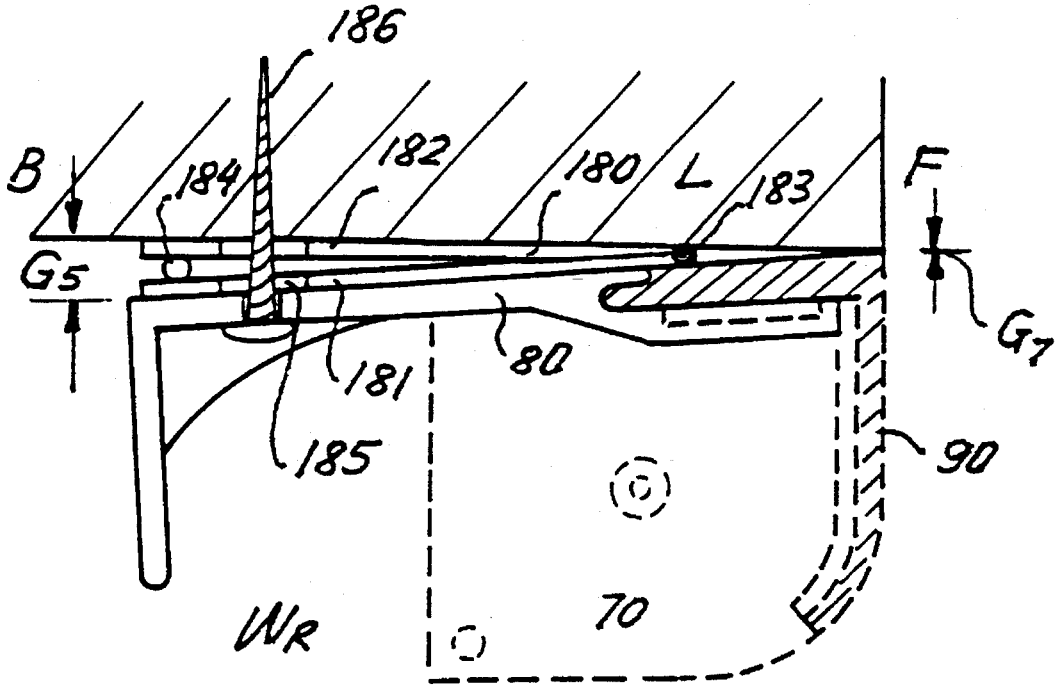
FIG. 19 is a side view of yet another version of an adjustable wedge.

FIG. 19 shows an alternative version to adjustable wedge versions shown in FIGS. 16 and 17. Adjustable wedge 180 consists of two blades: lower blade 181 and upper blade 182, able to rotate around screw 183. Any necessary angular adjustment can be provided by placement of a small wedge 184. Size and position of wedge 184 determines the magnitude of the angular adjustment of mounting bracket 80.

Wedge 180 has oval hole 185 needed for main screw 186. A larger size of hole 185 provides a useful opportunity for moving wedge 180 toward the front F of back B of the window opening for a better control of gap $G_7$. In order to fully control the position of gap $G_7$ (reduce it to zero) angular adjustment of end plate 70 (or 60) is needed. This can be accomplished by any of the means 142, 144, 146, 148 or 150 presented previously.

As an variation of a combination of mounting bracket 80 and adjustable wedge 180 presented in FIG. 19, a system in which lower blade 181 is either permanently attached to bracket 80 or becomes an integral part of bracket 80, can be devised.

Figure 20:
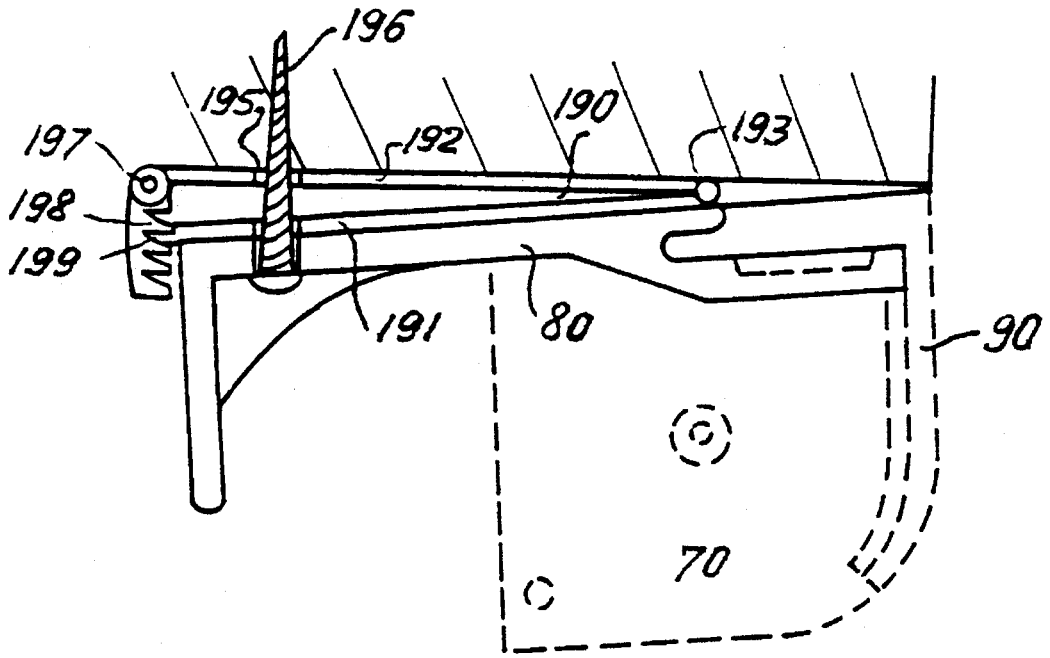
FIG. 20 is a side view of yet another version of an adjustable wedge.

FIG. 20 shows an adjustable wedge 190 that is similar to wedge 180 with the exception of the angle adjusting mechanism 194 replacing small wedge 184 to keep wedge 190 in its desired position. Adjusting mechanism 194 is connected with upper blade 192 by the means of screw 197 around which mechanism 194 can rotate. Mechanism 194 has keyways 198 corresponding with key 199 of lower blade 191. Similar to wedge 180, oval holes 195 are provided for screw 196.

Figure 21:
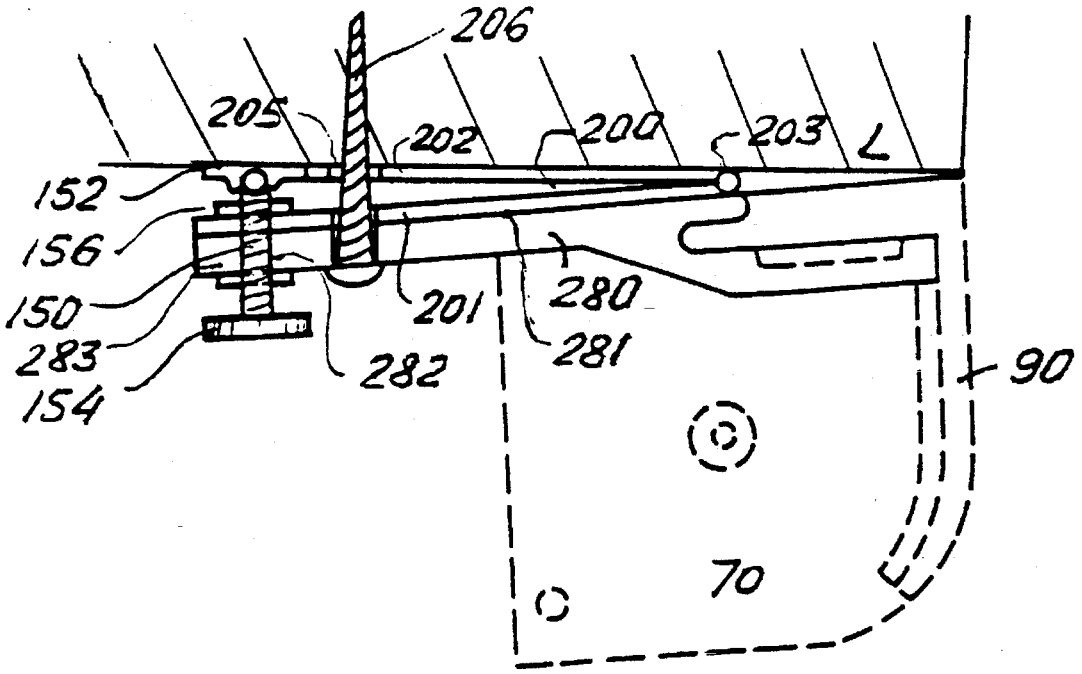
FIG. 21 is a side view of an adjustable mounting bracket.

FIG. 21 shows an adjustable wedge 200 that is yet another variation of wedges 180 and 190, with the exception of the angle adjusting mechanism 150 that is virtually identical in concept to the one used for adjustment of the end plates 60 or 70. Threaded adjustment screw 150 goes through the top plate 281 of modified bracket 280 and adjacent low plate 201 end wedge 200. Adjusting screw 150 passes through a threaded hole 282 and is locked in the desired position by one or more locking nuts 156. Adjustment for screw 150, and therefore bracket 280 and any shade 20 which may be suspended therefrom, is provided by turning adjustment knob 154 in the desired direction to cause the back end 283 of bracket 280 to be displaced toward or away from lintel L. As an example, if bracket 280 together with wedge 200 were located toward the right end of the shade assembly, and the right edge of the shade was found to be too close to the window frame (gap $G_2$ becoming close to zero), lowering the right side 283 of bracket 280 will angularly shift the assembly to cause the attached shade 20 to shift angularly away from the window wall $W_R$. Obviously, similar adjustment may also on the left side of the shade assembly if external gap $G_1$, became too close to zero. As a variation, low blade 201 can be permanently attached or combined with bracket 280 (or 80).

Figure 22:
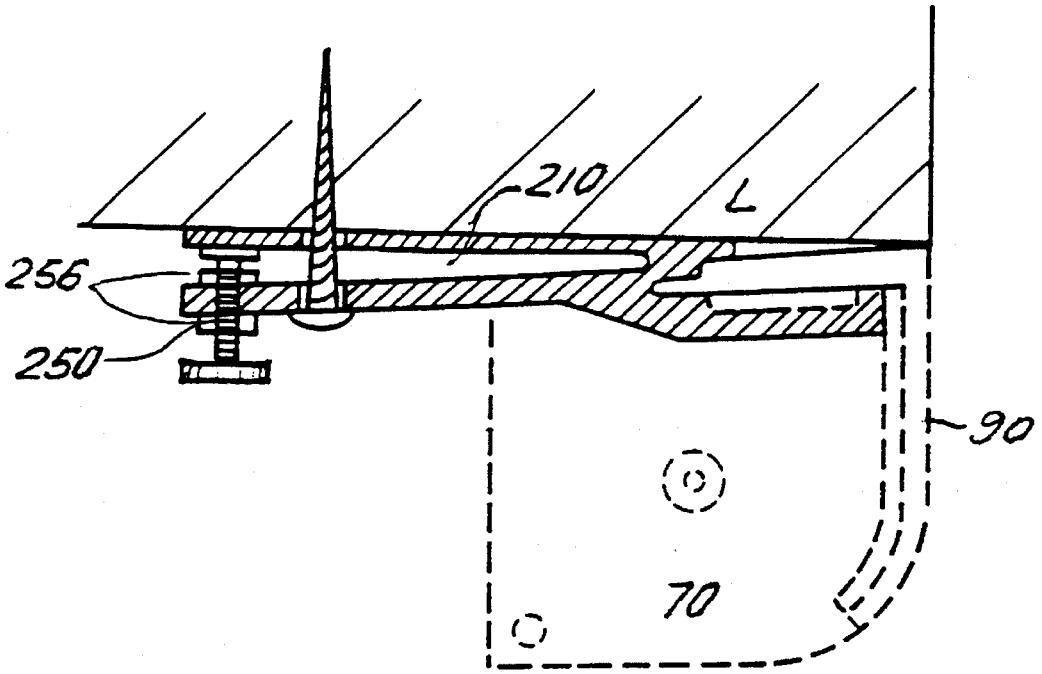
FIG. 22 is a side view of an alternative adjustable mounting bracket.

FIG. 22 shows a combination 210 of bracket 280 and wedge 200 with the adjusting screw mechanism 250 similar to mechanism 150 shown in FIG. 21.

Figure 23:
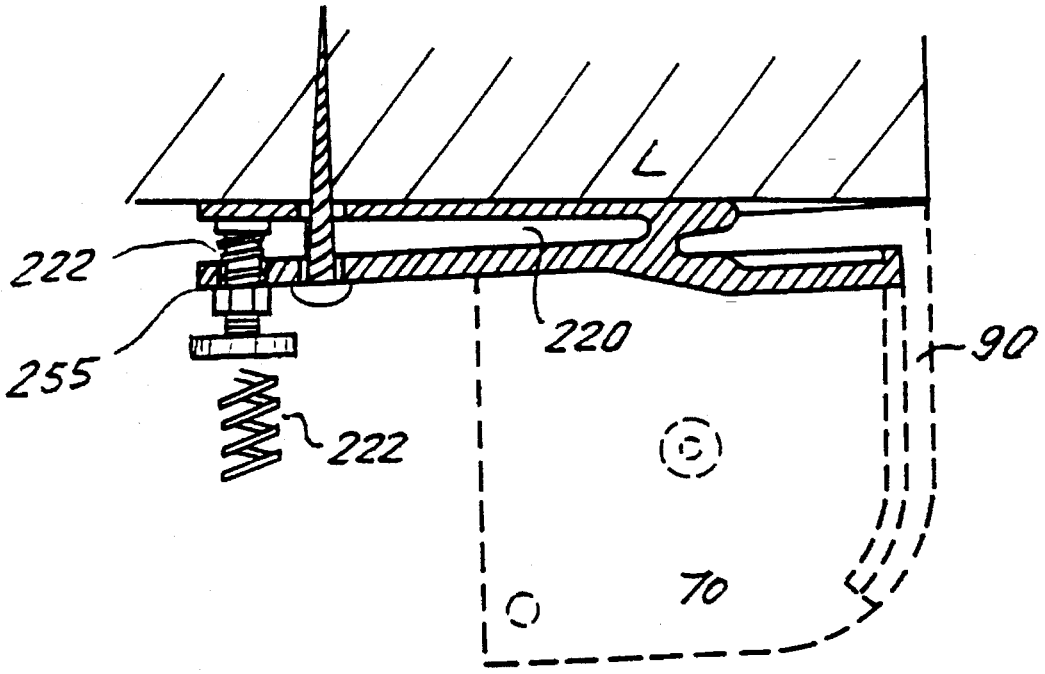
FIG. 23 is a side view of yet another adjustable mounting bracket.

FIG. 23 shows adjustable bracket 220, that is similar to bracket 210, with the exception of resistance spring 222 which makes adjusting screw mechanism 255 slightly different from mechanism 250 shown in FIG. 22. Resistance from spring 222 needs to be overcome in case when for some reason angular adjustment of mounting 90 needs to be reduced. Thus, spring 222 works as an alternative, and probably a more flexible device than upper locking nut 256, see FIG. 22.

From the foregoing, it will be seen that a variety of means providing for the angular and lateral adjustment of roller shades within their respective window frames or openings is disclosed. Most of the various means disclosed above may be combined in various ways to provide an optimum effect. Moreover, it will be seen that several means relating to the adjustment of the effective diameter of a shade roller (Procedure B) may be applied to roller shades lacking housing, such as the well known spring wound roller shade. Similar, adjustments relating to torsional adjustment of central housing or head rail can be applicable in several window covering systems, old and new, that are different from the Silhouette Shade system developed by Hunter Douglas.

It is to be understood that the present invention is not limited to the sole embodiments described above, but encompasses any and all embodiments within the scope of the following claims.

I claim:

1. Means for the angular adjustment of a rectangular window shade within a window opening, said window shade at least partially rolled upon a window shade roller, said window shade roller having a first end and a second end and an effective diameter, said means comprising;

at least one device installed at a location upon said window shade roller, whereby said device provides an increase in said effective diameter of said window shade roller at and around said location where said device is installed and said increase in said effective diameter of said window shade roller at said location skews said window shade toward said location of said window shade roller having said increase in said effective diameter.

2. The means of claim 1 wherein;

said device comprises at lease one screw, said screw driven into said window shade roller.

3. The means of claim 1 wherein;

said device comprises at least one pad, said pad secured to said window shade roller.

4. The means of claim 3 wherein;

said pad is adhesively secured to said window shade roller.

5. The means of claim 3 wherein;

said window shade roller is formed of a ferrous material, and said pad is magnetically secured to said window shade roller.

6. The means of claim 1 wherein;

said device comprises at least one button, said button secured to said window shade roller.

7. The means of claim 6 wherein;

said button is adhesively secured to said window shade roller.

8. The means of claim 6, wherein;

said window shade roller is formed of a ferrous material, and said button is magnetically secured to said window shade roller.

9. The means of claim 1 wherein;

said window shade roller includes at least one axially parallel extension, and said device is installed upon said axially parallel extension of said window shade roller.

10. The means of claim 9 wherein;

said device comprises at least one clip.

11. The means of claim 9 wherein said device comprises a blade that is adjustably secured to the said axially parallel extension.

12. The means of claim 9 wherein;

said device comprises an extension blade having a slot cooperating with said axially parallel extension of said window shade roller and a blade portion opposite said slot, said extension blade secured to said axially parallel extension of said window shade roller by means of said slot of said extension blade and extending continually therealong.

13. The means of claim 12 wherein;

said blade portion of said extension blade is tapered.

14. The means of claim 12 wherein;

said blade portion of said extension blade is adjustably secured to said extension blade.

15. The combination of a window covering system and a means providing for angular adjustment of said window covering system, said window covering system including a head rail attached to a window opening, said means comprising;

a device for imposing a torsional adjustment on a side of said head rail to accomplish angular adjustment of said window covering system;

wherein said device occupies an area between said head rail and said window opening.

16. The means of claim 15 further comprising:

locking means for maintaining the imposed torsional adjustment of said head rail;

a roller;

wherein said head rail includes a housing assembly, said roller being installed within said housing assembly, said housing assembly includes a first end plate, a second end plate and a plurality of mounting brackets attaching said housing assembly to said window opening.

17. The means of claim 16, wherein;

said device includes a wedge installed between said first end plate and said window opening.

18. The means of claim 17 wherein;

said wedge includes a circular cross section, whereby said wedge is inserted or rolled into position between said first end plate and said window opening.

19. The means of claim 16 wherein;

said device comprises a turnbuckle installed between said end plate and said window opening.

20. The means of claim 16 wherein;

at least one said end plate includes a flange, said flange includes a threaded hole, and said device comprises an adjustment screw threadibly secured within said threaded hole in said flange to provide and adjustable space between said end plate and said window opening.

21. The means of claim 20 wherein;

said adjustment screw includes a window opening contact end having a pad and an adjustment end having an adjustment knob.

22. The means of claim 16 wherein;

said device comprises an anchor screw secured within a hole in the relevant side wall of said window opening.

23. The means of claim 22 wherein;

said anchor screw goes through a hole in said end plate.

24. The means of claim 16 wherein;

at least one said mounting bracket is supplemented by said device, said device comprises at least one wedge able to maintain the desired angular bias of said mounting bracket.

25. The means of claim 24 wherein;

said wedge is angularly adjustable.

26. The means of claim 16 wherein;

said attachment bracket and said wedge are combined to produce a modified, angularly modified bracket.

27. The means of claim 24 wherein;

lateral positions of said attachment brackets and said wedge can be altered on said lintel in order to regulate the magnitude of angular adjustment of said shade.

28. The means of claim 27 wherein;

said wedge is constructed from wholes and parts of adhesive pads.

29. The means of claim 27 wherein;

said wedge is constructed from elementary wedges of different lengths adhesively attached to said attachment bracket.

30. The means of claim 29 wherein;

said device comprises of lower and upper blades, the magnitude of the angular adjustment regulated by bar inserted between said lower and upper blades of adjustable wedge.

31. The means of claim 30 wherein;

said angular adjustment is regulated by a lever.

32. The means of claim 30 wherein;

said angular adjustment is flexibly regulated by an adjustable screw mechanism, said screw mechanism comprising a screw, a lintel contact pad, adjustment knob, and at least one locking nut.

33. The means of claim 32 wherein:

said adjustable wedge is permanently connected with said attachment bracket.

34. The means of claim 33 wherein said adjustable screw mechanism is equipped with a resistance spring.

35. The means of claim 16, wherein said device is located proximate to the top rear of the head rail, and the top front of said first and second end plate is flush with the top of said window opening.

36. A method of improving the geometric fit of a rectangular window shade hung from a roller laterally eccentrically within an imperfect rectangular window opening, said roller being part of a roller assembly having spaced left and right end plates with a roller actuating mechanism mounted on one of said end plates and an end plug mounted on the other of said end plates with said roller being journalled on and between said mechanism and said end plug, said mechanism being of greater axial extent than said end plug, and said shade being overly displaced in the direction of the other of said end plates creating an oversized gap, said method comprising the steps of removing said end plug and said roller actuating mechanism from said roller assembly, reversing same, and re-installing same such that the roller actuating mechanism and end plug reverse places with the result that said shade is counter-displaced from its original lateral position to assume a more closely symmetrical suspension within said window opening.

37. The method of claim 36, wherein said window shade assembly is asymmetrical.

* * * * *